US012708139B2

(12) United States Patent
Batista et al.

(10) Patent No.: US 12,708,139 B2
(45) Date of Patent: Aug. 18, 2026

(54) AEROSOL-GENERATING ROD WITH MULTIPLE AEROSOL-GENERATING SEGMENTS

(71) Applicant: Philip Morris Products S.A., Neuchatel (CH)

(72) Inventors: Rui Nuno Rodrigues Alves Batista, Morges (CH); Bekele Alemu Bedasso, Neuchatel (CH); Gianluca Bongiovanni, Boudry (CH); Valerio Oliana, Pully (CH); Alexandra Sereda, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 452 days.

(21) Appl. No.: 18/262,796

(22) PCT Filed: Jan. 28, 2022

(86) PCT No.: PCT/EP2022/052083
§ 371 (c)(1),
(2) Date: Jul. 25, 2023

(87) PCT Pub. No.: WO2022/167342
PCT Pub. Date: Aug. 11, 2022

(65) Prior Publication Data

US 2024/0074489 A1 Mar. 7, 2024

(30) Foreign Application Priority Data

Feb. 2, 2021 (EP) ..... 21154825

(51) Int. Cl.
*A24D 1/20* (2020.01)
*A24D 1/00* (2020.01)
(Continued)

(52) U.S. Cl.
CPC ..... *A24D 1/20* (2020.01); *A24D 1/002* (2013.01); *A24D 1/02* (2013.01); *A24D 1/18* (2013.01)

(58) Field of Classification Search
None
See application file for complete search history.

(56) References Cited

U.S. PATENT DOCUMENTS

2019/0159517 A1 5/2019 Ballesteros Gomez et al.
2021/0329964 A1 10/2021 Deforel et al.
(Continued)

FOREIGN PATENT DOCUMENTS

CN 109965366 A 7/2019
CN 111296889 A 6/2020
(Continued)

OTHER PUBLICATIONS

Combined Chinese Office Action and Search Report issued Nov. 28, 2025 in Chinese Patent Application No. 202280011466.4 (with English Translation), 19 pages.
(Continued)

*Primary Examiner* — Dennis R Cordray
(74) *Attorney, Agent, or Firm* — Oblon, McClelland, Maier & Neustadt, L.L.P.

(57) ABSTRACT

An aerosol-generating article including an aerosol-generating rod for producing an inhalable aerosol upon heating is provided, the rod including: a first aerosol-generating segment including a first aerosol-generating substrate, the first aerosol-generating substrate including a tobacco material and an aerosol former; a second aerosol-generating segment at a location upstream of the first aerosol-generating segment; and a wrapper circumscribing at least the first aerosol-generating segment and the second aerosol-generating segment, the second aerosol-generating segment including a
(Continued)

plug of a porous substrate, and at least a core portion of the plug including an aerosol-generating medium or a flavourant or both. An aerosol-generating system including a heating device and the aerosol-generating article is also provided.

18 Claims, 2 Drawing Sheets

(51) Int. Cl.
*A24D 1/02* (2006.01)
*A24D 1/18* (2006.01)

(56) References Cited

U.S. PATENT DOCUMENTS

| | | | |
|---|---|---|---|
| 2021/0345659 | A1 | 11/2021 | Arndt et al. |
| 2021/0368860 | A1 | 12/2021 | Reevell |
| 2022/0001120 | A1 | 1/2022 | Ballesteros Gomez et al. |

FOREIGN PATENT DOCUMENTS

| | | | |
|---|---|---|---|
| CN | 111343874 | A | 6/2020 |
| CN | 111655050 | A | 9/2020 |
| EP | 0 503 767 | A1 | 9/1992 |
| EP | 0 822 670 | B1 | 11/2005 |
| EP | 2 854 576 | B1 | 12/2020 |
| EP | 3 747 283 | A1 | 12/2020 |
| JP | 2019-526237 | A | 9/2019 |
| JP | 2020-520678 | A | 7/2020 |
| JP | 2020-522241 | A | 7/2020 |
| JP | 2021-526384 | A | 10/2021 |
| RU | 2 656 810 | C2 | 6/2018 |
| RU | 2 704 893 | C2 | 10/2019 |
| WO | WO 2015/176898 | A1 | 11/2015 |
| WO | WO 2019/110747 | A1 | 6/2019 |
| WO | WO 2019/151687 | A1 | 8/2019 |
| WO | WO 2020/074494 | A1 | 4/2020 |
| WO | WO 2020/074535 | A1 | 4/2020 |
| WO | WO 2020/089067 | A1 | 5/2020 |
| WO | WO 2020/115151 | A1 | 11/2020 |
| WO | WO 2020/256341 | A1 | 12/2020 |
| WO | WO 2022/074159 | A1 | 4/2022 |

OTHER PUBLICATIONS

Combined Russian Office Action and Search Report issued Aug. 28, 2025 in Russian Patent Application No. 2023122727/03 (with English Translation of Office Action only), 9 pages.

Japanese Office Action issued Jan. 26, 2026, in corresponding Japanese Patent Application No. 2023-544764 (with English Translation), 8 pages.

Extended European Search Report issued May 12, 2025 in European Patent Application No. 25158565.9, 9 pages.

Extended European Search Report issued Jul. 19, 2021 in European Patent Application No. 21154825.0, 10 pages.

International Search Report & Written Opinion issued May 3, 2022 in PCT/EP2022/052083 filed on Jan. 28, 2022, 13 pages.

International Preliminary Report on Patentability & Written Opinion issued Jan. 19, 2023 in PCT/EP2022/052083 filed on Jan. 28, 2022, 18 pages.

AEROSOL-GENERATING ROD WITH MULTIPLE AEROSOL-GENERATING SEGMENTS

The present invention relates to an aerosol-generating article comprising an aerosol-generating substrate and adapted to produce an inhalable aerosol upon heating.

Aerosol-generating articles in which an aerosol-generating substrate, such as a tobacco-containing substrate, is heated rather than combusted, are known in the art. Typically, in such heated smoking articles an aerosol is generated by the transfer of heat from a heat source to a physically separate aerosol-generating substrate or material, which may be located in contact with, within, around, or downstream of the heat source. During use of the aerosol-generating article, volatile compounds are released from the aerosol-generating substrate by heat transfer from the heat source and are entrained in air drawn through the aerosol-generating article. As the released compounds cool, they condense to form an aerosol.

A number of prior art documents disclose aerosol-generating devices for consuming aerosol-generating articles. Such devices include, for example, electrically heated aerosol-generating devices in which an aerosol is generated by the transfer of heat from one or more electrical heater elements of the aerosol-generating device to the aerosol-generating substrate of a heated aerosol-generating article. For example, electrically heated aerosol-generating devices have been proposed that comprise an internal heater blade which is adapted to be inserted into the aerosol-generating substrate. As an alternative, inductively heatable aerosol-generating articles comprising an aerosol-generating substrate and a susceptor arranged within the aerosol-generating substrate have been proposed by WO 2015/176898. A further alternative has been described in WO 2020/115151, which discloses an aerosol-generating article used in combination with an external heating system comprising one or more heating elements arranged around the periphery of the aerosol-generating article. For example, external heating elements may be provided in the form of flexible heating foils on a dielectric substrate, such as polyimide.

Aerosol-generating articles in which a tobacco-containing substrate is heated rather than combusted present a number of challenges that were not encountered with conventional smoking articles.

First of all, tobacco-containing substrates are typically heated to significantly lower temperatures compared with the temperatures reached by the combustion front in a conventional cigarette. This may have an impact on nicotine release from the tobacco-containing substrate and nicotine delivery to the consumer. At the same time, if the heating temperature is increased in an attempt to boost nicotine delivery, then the aerosol generated typically needs to be cooled to a greater extent and more rapidly before it reaches the consumer.

Secondly, heating a tobacco-containing aerosol-generating substrate even to one such temperature required for aerosol formation typically takes some time, and so there may be a delay in aerosol delivery to the consumer. This phenomenon, whereby when the user initially draws upon the article, the aerosol reaching the user may be relatively low in flavour or nicotine content or both, is often referred to as "cold puff" effect or "empty puff" effect.

One such delay may for example be detected in aerosol-generating rods and articles wherein the aerosol-generating substrate comprises a homogenised tobacco material, since the aerosol former and nicotine may not be especially readily available for release. In particular, this may occur where a cast leaf homogenised tobacco material is used that has been prepared from a slurry containing the aerosol former, as opposed to one wherein the aerosol former has been applied (e.g., sprayed) onto the formed sheet.

It has been proposed to address this by providing two or more independent heating zones in the device by which the aerosol-generating rod or article is heated. As this enables different heating profiles to be implemented for different portions of the aerosol-generating substrate, this may help counter the "cold puff" effect.

It would, however, be desirable to provide a new and improved aerosol-generating rod or article adapted to address the initial "cold puff" or "empty puff" effect. For example, it would be desirable to provide a novel and improved aerosol-generating rod or article capable of more promptly providing a satisfactory aerosol delivery to the user and enables a finer tuning of the aerosol delivery during use, as a whole.

It would be especially desirable to provide one such novel and improved aerosol-generating rod or article that can generate a satisfactory aerosol delivery to the user at lower temperatures while still heating the tobacco-containing substrate for regular consumption.

It would be desirable to provide one such aerosol-generating rod or article that can be manufactured efficiently and at high speed without the need for extensive modification of existing equipment.

The present disclosure relates to an aerosol-generating rod for producing an inhalable aerosol upon heating. The aerosol-generating rod may comprise a first aerosol-generating segment. The first aerosol-generating segment may comprise a first aerosol-generating substrate. The first aerosol-generating substrate may comprise a tobacco material and an aerosol former. The aerosol-generating rod may comprise a second aerosol-generating segment. The second aerosol-generating segment may be at a location upstream of the first aerosol-generating segment. The second aerosol-generating segment may comprise a plug of a porous substrate. At least a core portion of the plug may comprise an aerosol-generating medium or a flavourant or both.

The present disclosure also relates to an aerosol-generating article comprising an aerosol-generating rod as described above, as well as to an aerosol-generating system comprising a heating device and one such aerosol-generating article.

According to the present invention there is provided an aerosol-generating rod for producing an inhalable aerosol upon heating. The aerosol-generating rod comprises: a first aerosol-generating segment comprising a first aerosol-generating substrate, wherein the first aerosol-generating substrate comprises a tobacco material and an aerosol former; and a second aerosol-generating segment at a location upstream of the first aerosol-generating segment. The second aerosol-generating segment comprises a plug of a porous substrate and wherein at least a core portion of the plug comprises an aerosol-generating medium or a flavourant or both.

According to the present invention there is also provided an aerosol-generating article comprising an aerosol-generating rod as described above, as well as an aerosol-generating system comprising a heating device and one such aerosol-generating article.

The aerosol-generating rod according to the present invention therefore provides a novel configuration of an aerosol-generating media. This novel configuration is characterised by the combination of two distinct aerosol-generating segments in a specific mutual arrangement. The inventors have found that by coupling two segments containing different aerosol-generating substrates inherently adapted to release volatiles species upon heating in accordance with different release profiles it is advantageously possible to obviate the initial delay in aerosol generation and delivery often found with existing aerosol-generating articles.

FIG. 3 shows qualitatively how aerosol delivery from each one of a segment containing homogenised tobacco substrate and a plug of a porous substrate loaded with an aerosol-generating medium or a flavourant evolves over time. As illustrated in FIG. 3 by line A, aerosol is released quickly from the aerosol-generating medium or flavourant in the loaded porous substrate plug upon starting to heat a rod containing both the segment containing homogenised tobacco substrate and the plug of loaded porous substrate. Aerosol delivery from the loaded porous substrate rapidly reaches a maximum before decreasing almost as rapidly. The content of aerosol species in the loaded porous substrate is depleted relatively quickly, and so release of aerosol from the aerosol-generating medium or a flavourant stops after a relatively short time. On the other hand, release of aerosol from the segment containing homogenised tobacco substrate, represented by line B, is initially less significant, and it is only after release of aerosol from the aerosol-generating medium or flavourant begins to decrease that the amount of aerosol released from the first aerosol-generating segment reaches a comparable level. By the time release of aerosol from the loaded porous substrate has all but stopped, release of aerosol from the segment containing homogenised tobacco substrate has more than doubled in intensity, and will only decrease smoothly over a longer period of time covering the remainder of the cycle of use of the rod or article.

At any time, during use of an aerosol-generating rod or article in accordance with the present invention, the consumer receives in effect the sum of a flow of aerosol species released from the aerosol-generating medium or flavourant provided in the second aerosol-generating segment and a flow of aerosol species released from the substrate of the first aerosol-generating segment. Dotted line C in FIG. 3 illustrates this effect during the initial portion of the cycle of use of the rod or article. As can be seen in the graph, release of aerosol from the second aerosol-generating segment compensates for the initial delay in the release of aerosol from the first aerosol-generating segment until the latter substantially takes over. This is perceived by the consumer as an overall more prompt, homogenous and consistent aerosol delivery throughout a cycle of use of the rod or article compared with existing aerosol-generating rods and articles.

Through selection of certain aerosol-generating media or flavourants for the second aerosol-generating segment, by adjusting the content of aerosol-generating medium or flavourant in the second aerosol-generating segment, through a selective choice of the tobacco-containing substrate and adjustment of the aerosol former content in the first aerosol-generating segment, etc., it is advantageously possible to fine tune the transition from one aerosol source to the other.

The inventors have found that compensation of the "cold puff" effect or "empty puff" effect is felt especially when the tobacco-containing substrate of the first aerosol-generating segment comprises a homogenised tobacco material incorporating an aerosol former. Without wishing to be bound by theory it is hypothesised that this is because the aerosol-generating medium or flavourant in the upstream second aerosol-generating segment is more readily available then the nicotine and aerosol former present within the tobacco-containing substrate of the first aerosol-generating segment.

This effect may be amplified by selecting an aerosol-generating medium or flavourant in the second aerosol-generating segment that is adapted to release aerosol species upon heating to a temperature T2 lower than the temperature T1 to which the tobacco-containing substrate in the first aerosol-generating segment begins to release aerosol species. In particular, as will be discussed in more detail below, the aerosol-generating medium or flavourant and the substrate in the first aerosol-generating segment may be selected such that a difference between the release temperatures T1 and T2 is greater than a predetermined value to enhance this effect.

Additionally or as an alternative, when an aerosol-generating article comprising a rod in accordance with the present invention is used within a device equipped with independent heating zones, heat (for example, heat generated by induction) can be supplied more quickly and at higher temperatures to the upstream second segment such that a first burst-like release of aerosol can be provided to the consumer while the temperature of the bulk of the tobacco-containing substrate in the first segment continues to be raised more gradually. As such, when aerosol coming from the tobacco-containing substrate begins to be released at a satisfactory rate and with desirable flavour and nicotine content, this flow provides a sustained release of aerosol for the remainder of the use cycle.

As discussed already, the present invention provides an aerosol-generating rod for producing an inhalable aerosol upon heating, as well as an aerosol-generating article comprising the rod and a system comprising an aerosol-generating device and the aerosol-generating article.

The term "aerosol generating article" is used herein to denote an article wherein an aerosol generating substrate is heated to produce and deliver an inhalable aerosol to a consumer. As used herein, the term "aerosol generating substrate" denotes a substrate capable of releasing volatile compounds upon heating to generate an aerosol.

A conventional cigarette is lit when a user applies a flame to one end of the cigarette and draws air through the other end. The localised heat provided by the flame and the oxygen in the air drawn through the cigarette causes the end of the cigarette to ignite, and the resulting combustion generates an inhalable smoke. By contrast, in heated aerosol generating articles, an aerosol is generated by heating a flavour generating substrate, such as tobacco. Known heated aerosol generating articles include, for example, electrically heated aerosol generating articles and aerosol generating articles in which an aerosol is generated by the transfer of heat from a combustible fuel element or heat source to a physically separate aerosol forming material. For example, aerosol generating articles according to the invention find particular application in aerosol generating systems comprising an electrically heated aerosol generating device having an internal heater blade which is adapted to be inserted into the rod of aerosol generating substrate. Aerosol generating articles of this type are described in the prior art, for example, in EP 0822670.

As used herein, the term "aerosol generating device" refers to a device comprising a heater element that interacts with the aerosol generating substrate of the aerosol generating article to generate an aerosol.

As used herein with reference to the present invention, the term "rod" is used to denote a generally elongate element, preferably a cylindrical element of substantially circular, oval or elliptical cross-section.

As used herein, the term "longitudinal" refers to the direction corresponding to the main longitudinal axis of the aerosol-generating article, which extends between the upstream and downstream ends of the aerosol-generating article. As used herein, the terms "upstream" and "downstream" describe the relative positions of elements, or portions of elements, of the aerosol-generating article in relation to the direction in which the aerosol is transported through the aerosol-generating article during use.

During use, air is drawn through the aerosol-generating article in the longitudinal direction. The term "transverse" refers to the direction that is perpendicular to the longitudinal axis. Any reference to the "cross-section" of the aerosol-generating article or a component of the aerosol-generating article refers to the transverse cross-section unless stated otherwise.

The term "length" denotes the dimension of a component of the aerosol-generating article in the longitudinal direction. For example, it may be used to denote the dimension of the rod or of the elongate tubular elements in the longitudinal direction.

The aerosol-generating article may further comprise a downstream section at a location downstream of the aerosol-generating rod. As will become apparent from the following description of embodiments of the aerosol-generating article of the invention, the downstream section may comprise one or more downstream elements.

The downstream section may comprise a hollow section between the mouth end of the aerosol-generating article and the aerosol-generating rod. The hollow section may comprise a hollow tubular element.

As used herein, terms such as "hollow tubular segment" and "hollow tubular element" are used to denote a generally elongate element defining a lumen or airflow passage along a longitudinal axis thereof. In particular, the term "tubular" will be used in the following with reference to an element or segment having a substantially cylindrical cross-section and defining at least one airflow conduit establishing an uninterrupted fluid communication between an upstream end of the tubular element or segment and a downstream end of the tubular element or segment. However, it will be understood that alternative geometries (for example, alternative cross-sectional shapes) of the tubular element or segment may be possible.

In the context of the present invention a hollow tubular segment or hollow tubular element provides an unrestricted flow channel. This means that the hollow tubular segment or hollow tubular element provides a negligible level of resistance to draw (RTD). The term "negligible level of RTD" is used to describe an RTD of less than 1 mm $H_2O$ per 10 millimetres of length of the hollow tubular segment or hollow tubular element, preferably less than 0.4 mm $H_2O$ per 10 millimetres of length of the hollow tubular segment or hollow tubular element, more preferably less than 0.1 mm $H_2O$ per 10 millimetres of length of the hollow tubular segment or hollow tubular element.

The flow channel should therefore be free from any components that would obstruct the flow of air in a longitudinal direction. Preferably, the flow channel is substantially empty.

In the present specification, a "hollow tubular segment" or "hollow tubular element" may also be referred to as a "hollow tube" or a "hollow tube segment".

The aerosol-generating article may further comprise an upstream section at a location upstream of the aerosol-generating rod. The upstream section may comprise one or more upstream elements. The upstream section may comprise an upstream element arranged immediately upstream of the aerosol-generating rod.

An aerosol-generating rod in accordance with the present invention may be substantially cylindrical and may have an external diameter of at least about 4 millimetres. More preferably, the aerosol-generating rod has an external diameter of at least about 5 millimetres. Even more preferably, the aerosol-generating rod has an external diameter of at least about 6 millimetres.

The aerosol-generating rod preferably has an external diameter of less than or equal to about 12 millimetres. More preferably, the element comprising the aerosol-generating rod has an external diameter of less than or equal to about 11 millimetres. Even more preferably, the aerosol-generating rod has an external diameter of less than or equal to about 8 millimetres.

, The aerosol-generating rod may have an external diameter from about 4 millimetres to about 12 millimetres, preferably from 5 millimetres to about 12 millimetres, more preferably from about 6 millimetres to about 12 millimetres. In other embodiments, the aerosol-generating rod has an external diameter from about 4 millimetres to about 11 millimetres, preferably from 5 millimetres to about 11 millimetres, more preferably from about 6 millimetres to about 11 millimetres. In further embodiments, the aerosol-generating rod has an external diameter from about 4 millimetres to about 8 millimetres, preferably from 5 millimetres to about 8 millimetres, more preferably from about 6 millimetres to about 8 millimetres.

In general, it has been observed that the smaller the diameter of a rod-shaped element comprising aerosol generating substrate, the lower the temperature that is required to raise a core temperature of the rod-shaped element such that sufficient amounts of vaporizable species are released from the aerosol-generating substrate to form a desired amount of aerosol. At the same time, without wishing to be bound by theory, it is understood that a smaller diameter of the rod-shaped element allows for a faster penetration of heat supplied to the aerosol-generating rod into its entire volume. Nevertheless, where the diameter of the rod-shaped element is too small, a volume-to-surface ratio of the aerosol-generating substrate becomes less favourable, as the amount of available aerosol-forming substrate diminishes.

A diameter of the aerosol-generating rod falling within the ranges described herein is particularly advantageous in terms of a balance between energy consumption and aerosol delivery. This advantage is felt in particular when an aerosol-generating article comprising an aerosol-generating rod having a diameter as described herein is used in combination with an external heater arranged around the periphery of the aerosol-generating rod or article. Under such operating conditions, it has been observed that less thermal energy is required to achieve a sufficiently high temperature at the core of the aerosol-generating rod or at the core of the article comprising the rod. Thus, when operating at lower temperatures, a desired target temperature at the core of the aerosol-generating rod may be achieved within a desirably reduced time frame and by a lower energy consumption.

An overall length of the aerosol-generating rod may be at least about 8 millimetres. Preferably, an overall length of the aerosol-generating rod is at least about 9 millimetres. More preferably, an overall length of the aerosol-generating rod is at least about 10 millimetres.

An overall length of the aerosol-generating rod is preferably less than or equal to about 27 millimetres. More preferably, an overall length of the aerosol-generating rod is preferably less than or equal to about 23 millimetres. Even more preferably, an overall length of the aerosol-generating rod is preferably less than or equal to about 19 millimetres.

In some embodiments, an overall length of the aerosol-generating rod is from about 8 millimetres to about 27 millimetres, preferably from about 9 millimetres to about 27 millimetres, more preferably from about 10 millimetres to about 27 millimetres. In other embodiments, an overall length of the aerosol-generating rod is from about 8 millimetres to about 23 millimetres, preferably from about 9 millimetres to about 23 millimetres, more preferably from about 10 millimetres to about 23 millimetres. In further embodiments, an overall length of the aerosol-generating rod is from about 8 millimetres to about 19 millimetres, preferably from about 9 millimetres to about 19 millimetres, more preferably from about 10 millimetres to about 19 millimetres.

Components of the aerosol-generating rod that will be described in more detail may be circumscribed by a wrapper, which may be a paper wrapper or a non-paper wrapper. One such wrapper may also attach two or more components of the aerosol-generating rod to each other.

Suitable paper wrappers for use in specific embodiments of the invention are known in the art and include, but are not limited to: cigarette papers; and filter plug wraps. Suitable non-paper wrappers for use in specific embodiments of the invention are known in the art and include, but are not limited to sheets of homogenised tobacco materials.

In certain embodiments the wrapper is non-porous. Preferably, the aerosol-generating rod comprises a non-porous wrapper that circumscribes at least the first aerosol-generating segment and the second aerosol-generating segment.

In certain embodiments, the wrapper may comprise a metallic foil. In certain preferred embodiments, the wrapper may be formed of a laminate material comprising a plurality of layers. Preferably, the wrapper is formed of an aluminium co-laminated sheet. The use of a co-laminated sheet comprising aluminium advantageously prevents combustion of the aerosol-generating substrate in the event that the aerosol-generating substrate should be ignited, rather than heated in the intended manner.

As described briefly above, an aerosol-generating rod in accordance with the present invention comprises a first aerosol-generating segment comprising a first aerosol-generating substrate, wherein the first aerosol-generating substrate comprises a tobacco material and an aerosol former.

An external diameter of the first aerosol-generating segment is substantially the same as an external diameter of the rod.

The first aerosol-generating segment may have a length of at least about 5 millimetres. Preferably, the first aerosol-generating segment has a length of at least about 7 millimetres. More preferably, the first aerosol-generating segment has a length of at least about 8 millimetres.

The first aerosol-generating segment may have a length of up to about 25 millimetres. Preferably, the first aerosol-generating segment has a length of less than or equal to about 20 millimetres. More preferably, the first aerosol-generating segment has a length of less than or equal to about 13 millimetres.

In some embodiments, the first aerosol-generating segment has a length from about 5 millimetres to about 25 millimetres, preferably from about 7 millimetres to about 25 millimetres, more preferably from about 8 millimetres to about 25 millimetres. In other embodiments, the first aerosol-generating segment has a length from about 5 millimetres to about 20 millimetres, preferably from about 7 millimetres to about 20 millimetres, more preferably from about 8 millimetres to about 20 millimetres. In further embodiments, the first aerosol-generating segment has a length from about 5 millimetres to about 13 millimetres, preferably from about 7 millimetres to about 13 millimetres, more preferably from about 8 millimetres to about 13 millimetres.

The first aerosol-generating substrate is a solid aerosol-generating substrate comprising tobacco plant material. The term "tobacco plant material" is used herein to denote material forming part of any plant member of the genus *Nicotiana*.

In certain preferred embodiments, the first aerosol-generating substrate comprises homogenised tobacco material.

Homogenised tobacco material is an example of "homogenised plant material". As used herein, the term "homogenised plant material" encompasses any plant material formed by the agglomeration of particles of plant. For example, sheets or webs of homogenised tobacco material for the aerosol-generating substrates of the present invention may be formed by agglomerating particles of tobacco material obtained by pulverising, grinding or comminuting one or more of tobacco leaf lamina and tobacco leaf stems. A homogenised plant material such as a homogenised tobacco material may be produced by casting, extrusion, paper making processes or other any other suitable processes known in the art.

The homogenised tobacco material can be provided in any suitable form. For example, the homogenised tobacco material may be in the form of one or more sheets. As used herein with reference to the invention, the term "sheet" describes a laminar element having a width and length substantially greater than the thickness thereof.

The homogenised tobacco material may be in the form of a plurality of pellets or granules.

The homogenised tobacco material may be in the form of a plurality of strands, strips or shreds. As used herein, the term "strand" describes an elongate element of material having a length that is substantially greater than the width and thickness thereof. The term "strand" should be considered to encompass strips, shreds and any other homogenised tobacco material having a similar form. The strands of homogenised tobacco material may be formed from a sheet of homogenised tobacco material, for example by cutting or shredding, or by other methods, for example, by an extrusion method.

In some embodiments, the strands may be formed in situ within the first aerosol-generating substrate as a result of the splitting or cracking of a sheet of homogenised tobacco material during formation of the first aerosol-generating substrate, for example, as a result of crimping. The strands of homogenised tobacco material within the aerosol-generating substrate may be separate from each other. Each strand of homogenised tobacco material within the first aerosol-generating substrate may be at least partially connected to an adjacent strand or strands along the length of the strands. For example, adjacent strands may be connected by one or more fibres. This may occur, for example, where the strands have been formed due to the splitting of a sheet of homogenised tobacco material during production of the first aerosol-generating substrate, as described above.

Preferably, the first aerosol-generating substrate is in the form of one or more sheets of homogenised tobacco material. In various embodiments of the invention, the one or more sheets of homogenised tobacco material may be produced by a casting process. In various embodiments of the invention, the one or more sheets of homogenised tobacco material may be produced by a paper-making process. The one or more sheets as described herein may each individually have a thickness of between 100 micrometres and 600 micrometres, preferably between 150 micrometres and 300 micrometres, and most preferably between 200 micrometres and 250 micrometres. Individual thickness refers to the thickness of the individual sheet, whereas combined thickness refers to the total thickness of all sheets that make up the aerosol-generating substrate. For example, if the first aerosol-generating substrate is formed from two individual sheets, then the combined thickness is the sum of the thickness of the two individual sheets or the measured thickness of the two sheets where the two sheets are stacked in the aerosol-generating substrate.

The one or more sheets as described herein may each individually have a grammage of between about 100 $g/m^2$ and about 300 $g/m^2$.

The one or more sheets as described herein may each individually have a density of from about 0.3 $g/cm^3$ to about 1.3 $g/cm^3$, and preferably from about 0.7 $g/cm^3$ to about 1.0 $g/cm^3$.

In embodiments of the present invention in which the first aerosol-generating substrate comprises one or more sheets of homogenised tobacco material, the sheets are preferably in the form of one or more gathered sheets. As used herein, the term "gathered" denotes that the sheet of homogenised tobacco material is convoluted, folded, or otherwise compressed or constricted substantially transversely to the cylindrical axis of a plug or a rod.

The one or more sheets of homogenised tobacco material may be gathered transversely relative to the longitudinal axis thereof and circumscribed with a wrapper to form a continuous rod or a plug.

The one or more sheets of homogenised tobacco material may advantageously be crimped or similarly treated. As used herein, the term "crimped" denotes a sheet having a plurality of substantially parallel ridges or corrugations. Alternatively or in addition to being crimped, the one or more sheets of homogenised tobacco material may be embossed, debossed, perforated or otherwise deformed to provide texture on one or both sides of the sheet.

Preferably, each sheet of homogenised tobacco material may be crimped such that it has a plurality of ridges or corrugations substantially parallel to the cylindrical axis of the plug. This treatment advantageously facilitates gathering of the crimped sheet of homogenised tobacco material to form the plug. Preferably, the one or more sheets of homogenised tobacco material may be gathered. It will be appreciated that crimped sheets of homogenised tobacco material may have a plurality of substantially parallel ridges or corrugations disposed at an acute or obtuse angle to the cylindrical axis of the plug. The sheet may be crimped to such an extent that the integrity of the sheet becomes disrupted at the plurality of parallel ridges or corrugations causing separation of the material, and results in the formation of shreds, strands or strips of homogenised tobacco material.

The one or more sheets of homogenised tobacco material may be cut into strands as referred to above. In such embodiments, the aerosol-generating substrate comprises a plurality of strands of the homogenised tobacco material. The strands may be used to form a plug. Typically, the width of such strands is about 5 millimetres, or about 4 millimetres, or about 3 millimetres, or about 2 millimetres or less. The length of the strands may be greater than about 5 millimetres, between about 5 millimetres to about 15 millimetres, about 8 millimetres to about 12 millimetres, or about 12 millimetres. Preferably, the strands have substantially the same length as each other. The length of the strands may be determined by the manufacturing process whereby a rod is cut into shorter plugs and the length of the strands corresponds to the length of the plug. The strands may be fragile which may result in breakage especially during transit. In such cases, the length of some of the strands may be less than the length of the plug.

The plurality of strands preferably extend substantially longitudinally along the length of the first aerosol-generating substrate, aligned with the longitudinal axis. Preferably, the plurality of strands are therefore aligned substantially parallel to each other.

The homogenised tobacco material may comprise up to about 95 percent by weight of plant particles, on a dry weight basis. Preferably, the homogenised tobacco material comprises up to about 90 percent by weight of plant particles, more preferably up to about 80 percent by weight of plant particles, more preferably up to about 70 percent by weight of plant particles, more preferably up to about 60 percent by weight of plant particles, more preferably up to about 50 percent by weight of plant particles, on a dry weight basis.

For example, the homogenised tobacco material may comprise between about 2.5 percent and about 95 percent by weight of plant particles, or about 5 percent and about 90 percent by weight of plant particles, or between about 10 percent and about 80 percent by weight of plant particles, or between about 15 percent and about 70 percent by weight of plant particles, or between about 20 percent and about 60 percent by weight of plant particles, or between about 30 percent and about 50 percent by weight of plant particles, on a dry weight basis.

Sheets of homogenised tobacco material for use in the present invention may have a tobacco content of at least about 40 percent by weight on a dry weight basis, more preferably of at least about 50 percent by weight on a dry weight basis more preferably at least about 70 percent by weight on a dry weight basis and most preferably at least about 90 percent by weight on a dry weight basis.

With reference to the present invention, the term "tobacco particles" describes particles of any plant member of the genus *Nicotiana*. The term "tobacco particles" encompasses ground or powdered tobacco leaf lamina, ground or powdered tobacco leaf stems, tobacco dust, tobacco fines, and other particulate tobacco by-products formed during the treating, handling and shipping of tobacco. In a preferred embodiment, the tobacco particles are substantially all derived from tobacco leaf lamina. By contrast, isolated nicotine and nicotine salts are compounds derived from tobacco but are not considered tobacco particles for purposes of the invention and are not included in the percentage of particulate plant material.

The tobacco particles may be prepared from one or more varieties of tobacco plants. Any type of tobacco may be used in a blend. Examples of tobacco types that may be used include, but are not limited to, sun-cured tobacco, flue-cured tobacco, Burley tobacco, Maryland tobacco, Oriental tobacco, Virginia tobacco, and other specialty tobaccos.

Flue-curing is a method of curing tobacco, which is particularly used with Virginia tobaccos. During the flue-curing process, heated air is circulated through densely packed tobacco. During a first stage, the tobacco leaves turn yellow and wilt. During a second stage, the laminae of the leaves are completely dried. During a third stage, the leaf stems are completely dried.

Burley tobacco plays a significant role in many tobacco blends. Burley tobacco has a distinctive flavour and aroma and also has an ability to absorb large amounts of casing.

Oriental is a type of tobacco which has small leaves, and high aromatic qualities. However, Oriental tobacco has a milder flavour than, for example, Burley. Generally, therefore, Oriental tobacco is used in relatively small proportions in tobacco blends.

Kasturi, Madura and Jatim are subtypes of sun-cured tobacco that can be used. Preferably, Kasturi tobacco and flue-cured tobacco may be used in a blend to produce the tobacco particles. Accordingly, the tobacco particles in the particulate plant material may comprise a blend of Kasturi tobacco and flue-cured tobacco.

The tobacco particles may have a nicotine content of at least about 2.5 percent by weight, based on dry weight. More preferably, the tobacco particles may have a nicotine content of at least about 3 percent, even more preferably at least about 3.2 percent, even more preferably at least about 3.5 percent, most preferably at least about 4 percent by weight, based on dry weight.

In certain other embodiments of the invention, the homogenised tobacco material may comprise tobacco particles in combination with non-tobacco plant flavour particles. Preferably, the non-tobacco plant flavour particles are selected from one or more of: ginger particles, eucalyptus particles, clove particles and star anise particles. Preferably, in such embodiments, the homogenised tobacco material comprises at least about 2.5 percent by weight of the non-tobacco plant flavour particles, on a dry weight basis, with the remainder of the plant particles being tobacco particles. Preferably, the homogenised tobacco material comprises at least about 4 percent by weight of non-tobacco plant flavour particles, more preferably at least about 6 percent by weight of non-tobacco plant flavour particles, more preferably at least about 8 percent by weight of non-tobacco plant flavour particles and more preferably at least about 10 percent by weight of non-tobacco plant flavour particles, on a dry weight basis. Preferably, the homogenised tobacco material comprises up to about 20 percent by weight of non-tobacco plant flavour particles, more preferably up to about 18 percent by weight of non-tobacco plant flavour particles, more preferably up to about 16 percent by weight of non-tobacco plant flavour particles.

The weight ratio of the non-tobacco plant flavour particles and the tobacco particles in the particulate plant material forming the homogenised tobacco material may vary depending on the desired flavour characteristics and composition of the aerosol produced from the aerosol-generating substrate during use. Preferably, the homogenised tobacco material comprises at least a 1:30 weight ratio of non-tobacco plant flavour particles to tobacco particles, more preferably at least a 1:20 weight ratio of non-tobacco plant flavour particles to tobacco particles, more preferably at least a 1:10 weight ratio of non-tobacco plant flavour particles to tobacco particles and most preferably at least a 1:5 weight ratio of non-tobacco plant flavour particles to tobacco particles, on a dry weight basis.

The homogenised tobacco material preferably comprises no more than 95 percent by weight of the particulate plant material, on a dry weight basis. The particulate plant material is therefore typically combined with one or more other components to form the homogenised tobacco material.

The homogenised tobacco material may further comprise a binder to alter the mechanical properties of the particulate plant material, wherein the binder is included in the homogenised tobacco material during manufacturing as described herein. Suitable exogenous binders would be known to the skilled person and include but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof. Preferably, the binder comprises guar gum.

The binder may be present in an amount of from about 1 percent to about 10 percent by weight, based on the dry weight of the homogenised tobacco material, preferably in an amount of from about 2 percent to about 5 percent by weight, based on the dry weight of the homogenised tobacco material.

The homogenised tobacco material may further comprise one or more lipids to facilitate the diffusivity of volatile components (for example, aerosol formers, gingerols and nicotine), wherein the lipid is included in the homogenised tobacco material during manufacturing as described herein. Suitable lipids for inclusion in the homogenised tobacco material include, but are not limited to: medium-chain triglycerides, cocoa butter, palm oil, palm kernel oil, mango oil, shea butter, soybean oil, cottonseed oil, coconut oil, hydrogenated coconut oil, candelilla wax, carnauba wax, shellac, sunflower wax, sunflower oil, rice bran, and Revel A; and combinations thereof.

The homogenised tobacco material may further comprise a pH modifier.

The homogenised tobacco material may further comprise fibres to alter the mechanical properties of the homogenised tobacco material, wherein the fibres are included in the homogenised tobacco material during manufacturing as described herein. Suitable exogenous fibres for inclusion in the homogenised tobacco material are known in the art and include fibres formed from non-tobacco material and non-ginger material, including but not limited to: cellulose fibres; soft-wood fibres; hard-wood fibres; jute fibres and combinations thereof. Exogenous fibres derived from tobacco and/or ginger can also be added. Any fibres added to the homogenised tobacco material are not considered to form part of the "particulate plant material" as defined above. Prior to inclusion in the homogenised tobacco material, fibres may be treated by suitable processes known in the art including, but not limited to: mechanical pulping; refining; chemical pulping; bleaching; sulfate pulping; and combinations thereof. A fibre typically has a length greater than its width.

Suitable fibres typically have lengths of greater than 400 micrometres and less than or equal to 4 millimetres, preferably within the range of 0.7 millimetres to 4 millimetres. Preferably, the fibres are present in an amount of about 2 percent to about 15 percent by weight, most preferably at about 4 percent by weight, based on the dry weight of the substrate.

In the context of the present invention, the first aerosol-generating substrate further comprises one or more aerosol formers. Upon volatilisation, an aerosol former can convey other vaporised compounds released from the first aerosol-generating substrate upon heating, such as nicotine and flavourants, in an aerosol. Suitable aerosol formers for inclusion in the first aerosol-generating substrate are known in the art and include, but are not limited to: polyhydric alcohols, such as triethylene glycol, propylene glycol, 1,3-butanediol and glycerol; esters of polyhydric alcohols, such as glycerol mono-, di- or triacetate; and aliphatic esters of mono-, di- or polycarboxylic acids, such as dimethyl dodecanedioate and dimethyl tetradecanedioate.

In some embodiments, the first aerosol-generating substrate may comprise two or more of homogenised tobacco material, tobacco cast leaf and reconstituted tobacco.

By way of example, the first aerosol-generating substrate may comprise a sheet of homogenised tobacco material which is produced from a blend of high quality tobacco leaf material and wherein aerosol former is intimately combined with the tobacco leaf material prior to forming the sheet from the resulting mixture. One such homogenised tobacco material may be combined with a tobacco cast leaf or a reconstituted tobacco or both. The tobacco cast leaf or the reconstituted tobacco or both may for example be a standard cast leaf or standard reconstituted tobacco formed from tobacco particles, including but not limited to recovered tobacco particles, wherein the standard cast leaf or standard reconstituted tobacco is impregnated with aerosol former after being formed into a sheet.

The inventors have found that, when heated under the same conditions and for a same period of time, these tobacco materials may have different aerosol delivery profiles. In particular, a standard tobacco cast leaf may have a tendency to release aerosol species sooner and at lower temperatures compared with a standard reconstituted tobacco. In turn, a standard reconstituted tobacco may have a tendency to release aerosol species sooner and at lower temperatures compared with a homogenised tobacco material as described above. Thus, by adjusting the relative proportions of these different tobacco materials in the first aerosol-generating substrate, it is advantageously possibly to fine tune the timing and intensity of aerosol delivery from the first aerosol-generating segment during use.

The first aerosol-generating substrate may have an aerosol former content of between about 5 percent and about 30 percent by weight on a dry weight basis.

Preferably, the first aerosol-generating substrate has an aerosol former content of at least about 10 percent by weight on a dry weight basis, more preferably at least about 15 percent by weight on a dry weight basis.

The first aerosol-generating substrate has preferably an aerosol former content of less than or equal to about 25 percent by weight on a dry weight basis, more preferably less than or equal to about 20 percent by weight on a dry weight basis.

In some embodiments, the first aerosol-generating substrate has an aerosol former content from 5 percent to 25 percent by weight on a dry weight basis, preferably from 10 percent to 25 percent by weight on a dry weight basis, more preferably from 15 percent to 25 percent by weight on a dry weight basis. In other embodiments, the first aerosol-generating substrate has an aerosol former content from 5 percent to 20 percent by weight on a dry weight basis, preferably from 10 percent to 20 percent by weight on a dry weight basis, more preferably from 15 percent to 20 percent by weight on a dry weight basis.

In other embodiments, the first aerosol-generating substrate may have an aerosol former content of about 30 percent by weight to about 45 percent by weight. This relatively high level of aerosol former is particularly suitable for a first aerosol-generating substrate that is intended to be heated at a temperature of less than 275 degrees Celsius. In such embodiments, the first aerosol-generating substrate preferably comprises a homogenised tobacco material comprising between about 2 percent by weight and about 10 percent by weight of cellulose ether, on a dry weight basis and between about 5 percent by weight and about 50 percent by weight of additional cellulose, on a dry weight basis. The use of the combination of cellulose ether and additional cellulose has been found to provide a particularly effective delivery of aerosol when used in an aerosol-generating substrate having an aerosol former content of between 30 percent by weight and 45 percent by weight.

Suitable cellulose ethers include but are not limited to methyl cellulose, hydroxypropyl methyl cellulose, ethyl cellulose, hydroxyl ethyl cellulose, hydroxyl propyl cellulose, ethyl hydroxyl ethyl cellulose and carboxymethyl cellulose (CMC). In particularly preferred embodiments, the cellulose ether is carboxymethyl cellulose.

As used herein, the term "additional cellulose" encompasses any cellulosic material incorporated into the homogenised tobacco material which does not derive from the non-tobacco plant particles or tobacco particles provided in the homogenised tobacco material.

The additional cellulose is therefore incorporated in the homogenised tobacco material in addition to the non-tobacco plant material or tobacco material, as a separate and distinct source of cellulose to any cellulose intrinsically provided within the non-tobacco plant particles or tobacco particles. The additional cellulose will typically derive from a different plant to the non-tobacco plant particles or tobacco particles. Preferably, the additional cellulose is in the form of an inert cellulosic material, which is sensorially inert and therefore does not substantially impact the organoleptic characteristics of the aerosol generated from the aerosol-generating substrate. For example, the additional cellulose is preferably a tasteless and odourless material.

The additional cellulose may comprise cellulose powder, cellulose fibres, or a combination thereof.

The aerosol former may act as a humectant in the aerosol-generating substrate.

As described briefly above, an aerosol-generating rod in accordance with the present invention further comprises a second aerosol-generating segment at a location upstream of the first aerosol-generating segment.

The second aerosol-generating segment comprises a plug of a porous substrate.

The term "porous substrate" is used herein to describe a material that provides a plurality of pores or openings that allow the passage of air through the material. The porous substrate may be any suitable porous material able to hold or retain the aerosol-generating medium or flavour, particularly if these are provided in liquid or gel form, as will be discussed below.

An advantage of a porous substrate loaded with the aerosol-generating medium or flavour is that the aerosol-generating medium or flavour is retained within the porous medium, and this may aid manufacturing, storage or transport of the gel composition. This is especially effective when the aerosol-generating medium or flavour is in the form of a gel, as use of a porous substrate may assist in preserving the gel and maintaining the gel at the desired core location, especially during manufacture and transport, as well as during use.

In specific embodiments the porous substrate comprises natural materials, synthetic, or semi-synthetic, or a combination thereof. In specific embodiments the porous substrate comprises sheet material, foam, or fibres, for example loose fibres; or a combination thereof. In specific embodiments the porous substrate comprises a woven, non-woven, or extruded material, or combinations thereof. Preferably the porous substrate comprises, cotton, paper, viscose, PLA, or cellulose acetate, of combinations thereof. In some embodiments, the porous substrate may comprise a gathered sheet material, for example, made of cotton or cellulose acetate.

At least a core portion of the plug comprises an aerosol-generating medium or a flavourant or both.

Preferably, a peripheral portion of the plug surrounding the core portion is substantially free of aerosol-generating medium or flavourant. In preferred embodiments, the peripheral portion of the plug extends from a peripheral surface of the plug all the way to an outer boundary of the core portion. In other words, the core portion of the plug comprises an aerosol-generating medium or a flavourant or both and the remainder of the plug is substantially free of aerosol-generating medium or flavourant.

A cross-sectional area of the core portion may be at least about 30 percent of a cross-sectional area of the second segment. Preferably, a cross-sectional area of the core portion is at least about 40 percent of a cross-sectional area of the second segment. More preferably, a cross-sectional area of the core portion is at least about 50 percent of a cross-sectional area of the second segment. Even more preferably, a cross-sectional area of the core portion is at least about 60 percent of a cross-sectional area of the second segment.

A cross-sectional area of the core portion is preferably less than or equal to about 90 percent of a cross-sectional area of the second segment. More preferably, a cross-sectional area of the core portion is less than or equal to about 85 percent of a cross-sectional area of the second segment. Even more preferably, a cross-sectional area of the core portion is less than or equal to about 80 percent of a cross-sectional area of the second segment.

In some embodiments, a cross-sectional area of the core portion is from about 30 percent to about 90 percent of a cross-sectional area of the second segment, preferably from about 40 percent to about 90 percent of a cross-sectional area of the second segment, more preferably from about 50 percent to about 90 percent of a cross-sectional area of the second segment. In other embodiments, a cross-sectional area of the core portion is from about 30 percent to about 85 percent of a cross-sectional area of the second segment, preferably from about 40 percent to about 85 percent of a cross-sectional area of the second segment, more preferably from about 50 percent to about 85 percent of a cross-sectional area of the second segment. In further embodiments, a cross-sectional area of the core portion is from about 30 percent to about 80 percent of a cross-sectional area of the second segment, preferably from about 40 percent to about 80 percent of a cross-sectional area of the second segment, more preferably from about 50 percent to about 80 percent of a cross-sectional area of the second segment.

An external diameter of the second aerosol-generating segment is substantially the same as an external diameter of the rod.

The second aerosol-generating segment may have a length of at least about 2 millimetres. Preferably, the second aerosol-generating segment has a length of at least about 3 millimetres. More preferably, the second aerosol-generating segment has a length of at least about 4 millimetres.

The second aerosol-generating segment may have a length of up to about 10 millimetres. Preferably, the second aerosol-generating segment has a length of less than or equal to about 7 millimetres. More preferably, the second aerosol-generating segment has a length of less than or equal to about 5 millimetres.

In some embodiments, the second aerosol-generating segment has a length from about 2 millimetres to about 10 millimetres, preferably from about 3 millimetres to about 10 millimetres, more preferably from about 4 millimetres to about 10 millimetres. In other embodiments, the second aerosol-generating segment has a length from about 2 millimetres to about 17 millimetres, preferably from about 3 millimetres to about 7 millimetres, more preferably from about 4 millimetres to about 7 millimetres. In further embodiments, the second aerosol-generating segment has a length from about 2 millimetres to about 5 millimetres, preferably from about 3 millimetres to about 5 millimetres, more preferably from about 4 millimetres to about 5 millimetres.

In an aerosol-generating rod in accordance with the present invention, a ratio between a length of the second aerosol-generating segment and a length of the first aerosol-generating segment is at least about 0.15. Preferably, a ratio between a length of the second aerosol-generating segment and a length of the first aerosol-generating segment is at least about 0.2. More preferably, a ratio between a length of the second aerosol-generating segment and a length of the first aerosol-generating segment is at least about 0.3.

A ratio between a length of the second aerosol-generating segment and a length of the first aerosol-generating segment is preferably less than or equal to about 0.5. More preferably, a ratio between a length of the second aerosol-generating segment and a length of the first aerosol-generating segment is less than or equal to about 0.45. Even more preferably, a ratio between a length of the second aerosol-generating segment and a length of the first aerosol-generating segment is less than or equal to about 0.4.

In some embodiments, a ratio between a length of the second aerosol-generating segment and a length of the first aerosol-generating segment is from about 0.15 to about 0.5, preferably from about 0.2 to about 0.5, more preferably from about 0.3 to about 0.5. In other embodiments, a ratio between a length of the second aerosol-generating segment and a length of the first aerosol-generating segment is from about 0.15 to about 0.45, preferably from about 0.2 to about 0.45, more preferably from about 0.3 to about 0.45. In further embodiments, a ratio between a length of the second aerosol-generating segment and a length of the first aerosol-generating segment is from about 0.15 to about 0.4, preferably from about 0.2 to about 0.4, more preferably from about 0.3 to about 0.4.

The aerosol-generating medium or flavourant in the second aerosol-generating segment is preferably adapted to release volatile species upon heating to a second temperature (T2) lower than a first temperature (T1) at which the tobacco material in the first aerosol-generating segment begins to release volatile species.

A difference (T1-T2) between a first temperature (T1) at which the tobacco material in the first aerosol-generating segment begins to release volatile species and a second temperature (T2) at which the aerosol-generating medium or flavourant in the second aerosol-generating segment begins to release volatile species is at least about 15 degrees Celsius. Preferably, a difference (T1-T2) between a first temperature (T1) at which the tobacco material in the first aerosol-generating segment begins to release volatile species and a second temperature (T2) at which the aerosol-generating medium or flavourant in the second aerosol-generating segment begins to release volatile species is at least about 20 degrees Celsius. More preferably, a difference (T1-T2) between a first temperature (T1) at which the tobacco material in the first aerosol-generating segment begins to release volatile species and a second temperature (T2) at which the aerosol-generating medium or flavourant in the second aerosol-generating segment begins to release volatile species is at least about 30 degrees Celsius.

A difference (T1-T2) between a first temperature (T1) at which the tobacco material in the first aerosol-generating segment begins to release volatile species and a second temperature (T2) at which the aerosol-generating medium or flavourant in the second aerosol-generating segment begins to release volatile species may be less than about 80 degrees Celsius. Preferably, a difference (T1-T2) between a first temperature (T1) at which the tobacco material in the first aerosol-generating segment begins to release volatile species and a second temperature (T2) at which the aerosol-generating medium or flavourant in the second aerosol-generating segment begins to release volatile species is less than or equal to about 70 degrees Celsius. More preferably, a difference (T1-T2) between a first temperature (T1) at which the tobacco material in the first aerosol-generating segment begins to release volatile species and a second temperature (T2) at which the aerosol-generating medium or flavourant in the second aerosol-generating segment begins to release volatile species is less than or equal to about 60 degrees Celsius.

In some embodiments, a difference (T1-T2) between a first temperature (T1) at which the tobacco material in the first aerosol-generating segment begins to release volatile species and a second temperature (T2) at which the aerosol-generating medium or flavourant in the second aerosol-generating segment begins to release volatile species is from about 15 degrees Celsius to about 80 degrees Celsius, preferably from about 20 degrees Celsius to about 80 degrees Celsius, more preferably from about 30 degrees Celsius to about 80 degrees Celsius. In other embodiments, a difference (T1-T2) between a first temperature (T1) at which the tobacco material in the first aerosol-generating segment begins to release volatile species and a second temperature (T2) at which the aerosol-generating medium or flavourant in the second aerosol-generating segment begins to release volatile species is from about 15 degrees Celsius to about 80 degrees Celsius, preferably from about 20 degrees Celsius to about 70 degrees Celsius, more preferably from about 30 degrees Celsius to about 70 degrees Celsius. In further embodiments, a difference (T1-T2) between a first temperature (T1) at which the tobacco material in the first aerosol-generating segment begins to release volatile species and a second temperature (T2) at which the aerosol-generating medium or flavourant in the second aerosol-generating segment begins to release volatile species is from about 15 degrees Celsius to about 60 degrees Celsius, preferably from about 20 degrees Celsius to about 60 degrees Celsius, more preferably from about 30 degrees Celsius to about 60 degrees Celsius.

By combining an aerosol-generating medium or flavour or both in the second aerosol-generating segment and a tobacco material in the first aerosol-generating segment having the relationship described above it is advantageously possible to efficiently counter the "cold puff" effect. In addition, it may be possible to achieve during use, a desirably smooth transition from a ramp-up phase, during which the second aerosol-generating segment is the primary source of aerosol species delivered to the consumer, and a plateau phase, during which the first aerosol-generating segment becomes and remains the primary source of aerosol species delivered to the consumer.

The aerosol-generating medium or flavour may be adapted to release volatile species upon heating to a temperature of at least about 50 degrees Celsius. Preferably, the aerosol-generating medium or flavour is adapted to release volatile species upon heating to a temperature of at least about 60 degrees Celsius. More preferably, the aerosol-generating medium or flavour is adapted to release volatile species upon heating to a temperature of at least about 70 degrees Celsius. Even more preferably, the aerosol-generating medium or flavour is adapted to release volatile species upon heating to a temperature of at least about 80 degrees Celsius.

The aerosol-generating medium or flavour may be adapted to release volatile species upon heating to a temperature of less than about 140 degrees Celsius. Preferably, the aerosol-generating medium or flavour is adapted to release volatile species upon heating to a temperature of less than about 130 degrees Celsius. More preferably, the aerosol-generating medium or flavour is adapted to release volatile species upon heating to a temperature of less than about 110 degrees Celsius.

In some embodiments, the aerosol-generating medium or flavour is adapted to release volatile species upon heating to a temperature from about 60 degrees Celsius to about 140 degrees Celsius, preferably from about 70 degrees Celsius to about 140 degrees Celsius, more preferably from about 80 degrees Celsius to about 140 degrees Celsius. In other embodiments, the aerosol-generating medium or flavour is adapted to release volatile species upon heating to a temperature from about 60 degrees Celsius to about 130 degrees Celsius, preferably from about 70 degrees Celsius to about 130 degrees Celsius, more preferably from about 80 degrees Celsius to about 130 degrees Celsius. In further embodiments, the aerosol-generating medium or flavour is adapted to release volatile species upon heating to a temperature from about 60 degrees Celsius to about 110 degrees Celsius, preferably from about 70 degrees Celsius to about 110 degrees Celsius, more preferably from about 80 degrees Celsius to about 110 degrees Celsius.

The inventors have found that by providing a second aerosol-generating segment including an aerosol-generating medium or flavour adapted to release volatile species within the temperature ranges described above, it is advantageously possible to achieve a good compensation of the initial "cold puff" effect. Without wishing to be bound by theory, this is understood to be because these volatilisation temperatures are sufficiently far from volatilisation temperatures of the species contained in the tobacco material of the first aerosol-generating substrate. Further, it is understood that it is relatively easy to heat rapidly and effectively the aerosol-generating medium or flavour in the core portion of the plug of the second aerosol-generating segment upon starting to heat the rod, and so aerosol generation and delivery to the consumer can be initiated very promptly.

In some embodiments, the aerosol-generating medium comprises a liquid or gel impregnating the porous substrate.

In certain preferred embodiments, the aerosol-generating medium comprises a gel comprising an alkaloid compound; an aerosol former; and at least one gelling agent.

The term "alkaloid compound" refers to any one of a class of naturally occurring organic compounds that contain one or more basic nitrogen atoms. Generally, an alkaloid contains at least one nitrogen atom in an amine-type structure. This or another nitrogen atom in the molecule of the alkaloid compound can be active as a base in acid-base reactions. Most alkaloid compounds have one or more of their nitrogen atoms as part of a cyclic system, such as for example a heterocylic ring. In nature, alkaloid compounds are found primarily in plants, and are especially common in certain families of flowering plants. However, some alkaloid compounds are found in animal species and fungi. In this disclosure, the term "alkaloid compound" refers to both naturally derived alkaloid compounds and synthetically manufactured alkaloid compounds.

The aerosol-generating medium may preferably include an alkaloid compound selected from the group consisting of nicotine, anatabine, and combinations thereof.

Preferably the aerosol-generating medium includes nicotine.

The term "nicotine" refers to nicotine and nicotine derivatives such as free-base nicotine, nicotine salts and the like.

The aerosol-generating medium preferably includes about 0.5 percent by weight to about 10 percent by weight of an alkaloid compound. The aerosol-generating medium may include about 0.5 percent by weight to about 5 percent by weight of an alkaloid compound. Preferably the aerosol-generating medium includes about 1 percent by weight to about 3 percent by weight of an alkaloid compound. The aerosol-generating medium may preferably include about 1.5 percent by weight to about 2.5 percent by weight of an alkaloid compound. The aerosol-generating medium may preferably include about 2 percent by weight of an alkaloid compound.

The alkaloid compound component of the aerosol-generating medium may be the most volatile component of the aerosol-generating medium. In some embodiments the aerosol-generating medium may comprise water, and water may be the most volatile component of the aerosol-generating medium and the alkaloid compound component of the aerosol-generating medium may be the second most volatile component of the aerosol-generating medium.

Preferably nicotine is included in the aerosol-generating medium. The nicotine may be added to the aerosol-generating medium composition in a free base form or a salt form.

The aerosol-generating medium includes about 0.5 percent by weight to about 10 percent by weight nicotine, or about 0.5 percent by weight to about 5 percent by weight nicotine. Preferably the aerosol-generating medium includes about 1 percent by weight to about 3 percent by weight nicotine, or about 1.5 percent by weight to about 2.5 percent by weight nicotine, or about 2 percent by weight nicotine.

As described briefly above, the aerosol-generating medium preferably additionally includes an aerosol-former. Ideally the aerosol-former is substantially resistant to thermal degradation at the operating temperature of the associated aerosol-generating device. Suitable aerosol-formers include, but are not limited to: polyhydric alcohols, such as triethylene glycol, 1,3-butanediol and glycerin; esters of polyhydric alcohols, such as glycerol mono-, di- or triacetate; and aliphatic esters of mono-, di- or polycarboxylic acids, such as dimethyl dodecanedioate and dimethyl tetradecanedioate. Polyhydric alcohols or mixtures thereof, may be one or more of triethylene glycol, 1,3-butanediol and, glycerin (glycerol or propane-1,2,3-triol) or polyethylene glycol. The aerosol-former is preferably glycerol.

The aerosol-generating medium may be in the form of a gel.

The gel may preferably include an alkaloid compound selected from the group consisting of nicotine, anatabine, and combinations thereof.

Preferably the gel includes nicotine.

The term "nicotine" refers to nicotine and nicotine derivatives such as free-base nicotine, nicotine salts and the like.

The gel preferably includes about 0.5 percent by weight to about 10 percent by weight of an alkaloid compound. The gel may include about 0.5 percent by weight to about 5 percent by weight of an alkaloid compound. Preferably the gel includes about 1 percent by weight to about 3 percent by weight of an alkaloid compound. The gel may preferably include about 1.5 percent by weight to about 2.5 percent by weight of an alkaloid compound. The gel may preferably include about 2 percent by weight of an alkaloid compound.

The alkaloid compound component of the gel may be the most volatile component of the gel. In some embodiments the gel may comprise water, and water may be the most volatile component of the gel and the alkaloid compound component of the gel may be the second most volatile component of the gel.

Preferably nicotine is included in the gel. The nicotine may be added to the gel composition in a free base form or a salt form.

The gel includes about 0.5 percent by weight to about 10 percent by weight nicotine, or about 0.5 percent by weight to about 5 percent by weight nicotine. Preferably the gel includes about 1 percent by weight to about 3 percent by weight nicotine, or about 1.5 percent by weight to about 2.5 percent by weight nicotine, or about 2 percent by weight nicotine.

As described briefly above, the gel preferably additionally includes an aerosol-former. Ideally the aerosol-former is substantially resistant to thermal degradation at the operating temperature of the associated aerosol-generating device. Suitable aerosol-formers include, but are not limited to: polyhydric alcohols, such as triethylene glycol, 1,3-butanediol and glycerin; esters of polyhydric alcohols, such as glycerol mono-, di- or triacetate; and aliphatic esters of mono-, di- or polycarboxylic acids, such as dimethyl dodecanedioate and dimethyl tetradecanedioate. Polyhydric alcohols or mixtures thereof, may be one or more of triethylene glycol, 1,3-butanediol and, glycerin (glycerol or propane-1, 2,3-triol) or polyethylene glycol. The aerosol-former is preferably glycerol.

The gel may include a majority of an aerosol-former. The gel may include a mixture of water and the aerosol-former where the aerosol-former forms a majority (by weight) of the gel. The aerosol-former may form at least about 50 percent by weight of the gel. The aerosol-former may form at least about 60 percent by weight or at least about 65 percent by weight or at least about 70 percent by weight of the gel. The aerosol-former may form about 70 percent by weight to about 80 percent by weight of the gel. The aerosol-former may form about 70 percent by weight to about 75 percent by weight of the gel.

The gel may include a majority of glycerol. The gel may include a mixture of water and the glycerol where the glycerol forms a majority (by weight) of the gel. The glycerol may form at least about 50 percent by weight of the gel. The glycerol may form at least about 60 percent by weight or at least about 65 percent by weight or at least about 70 percent by weight of the gel. The glycerol may form about 70 percent by weight to about 80 percent by weight of the gel. The glycerol may form about 70 percent by weight to about 75 percent by weight of the gel.

The gel additionally preferably includes at least one gelling agent. Preferably, the gel composition includes a total amount of gelling agents in a range from about 0.4 percent by weight to about 10 percent by weight. More preferably, the gel includes the gelling agents in a range from about 0.5 percent by weight to about 8 percent by weight. More preferably, the gel includes the gelling agents in a range from about 1 percent by weight to about 6 percent by weight. More preferably, the gel includes the gelling agents in a range from about 2 percent by weight to about 4 percent by weight. More preferably, the gel includes the gelling agents in a range from about 2 percent by weight to about 3 percent by weight.

The term "gelling agent" refers to a compound that homogeneously, when added to a 50 percent by weight water/50 percent by weight glycerol mixture, in an amount of about 0.3 percent by weight, forms a solid medium or support matrix leading to a gel. Gelling agents include, but are not limited to, hydrogen-bond crosslinking gelling agents, and ionic crosslinking gelling agents.

The gelling agent may include one or more biopolymers. The biopolymers may be formed of polysaccharides.

Biopolymers include, for example, gellan gums (native, low acyl gellan gum, high acyl gellan gums with low acyl gellan gum being preferred), xanthan gum, alginates (alginic acid), agar, guar gum, and the like. The composition may preferably include xanthan gum. The composition may include two biopolymers. The composition may include three biopolymers. The composition may include the two biopolymers in substantially equal weights. The composition may include the three biopolymers in substantially equal weights.

Preferably, the gel comprises at least about 0.2 percent by weight hydrogen-bond crosslinking gelling agent. The gel preferably comprises at least about 0.2 percent by weight ionic crosslinking gelling agent. Most preferably, the gel comprises at least about 0.2 percent by weight hydrogen-bond crosslinking gelling agent and at least about 0.2 percent by weight ionic crosslinking gelling agent. The gel may comprise about 0.5 percent by weight to about 3 percent by weight hydrogen-bond crosslinking gelling agent and about 0.5 percent by weight to about 3 percent by weight ionic crosslinking gelling agent, or about 1 percent by weight to about 2 percent by weight hydrogen-bond crosslinking gelling agent and about 1 percent by weight to about 2 percent by weight ionic crosslinking gelling agent. The hydrogen-bond crosslinking gelling agent and ionic crosslinking gelling agent may be present in the gel in substantially equal amounts by weight.

The term "hydrogen-bond crosslinking gelling agent" refers to a gelling agent that forms non-covalent crosslinking bonds or physical crosslinking bonds via hydrogen bonding. Hydrogen bonding is a type of electrostatic dipole-dipole attraction between molecules, not a covalent bond to a hydrogen atom. It results from the attractive force between a hydrogen atom covalently bonded to a very electronegative atom such as a N, 0, or F atom and another very electronegative atom.

The hydrogen-bond crosslinking gelling agent may include one or more of a galactomannan, gelatin, agarose, or konjac gum, or agar. The hydrogen-bond crosslinking gelling agent may preferably include agar.

The gel preferably includes the hydrogen-bond crosslinking gelling agent in a range from about 0.3 percent by weight to about 5 percent by weight. Preferably the gel includes the hydrogen-bond crosslinking gelling agent in a range from about 0.5 percent by weight to about 3 percent by weight. Preferably the gel includes the hydrogen-bond crosslinking gelling agent in a range from about 1 percent by weight to about 2 percent by weight.

The gel may include a galactomannan in a range from about 0.2 percent by weight to about 5 percent by weight. Preferably the galactomannan may be in a range from about 0.5 percent by weight to about 3 percent by weight. Preferably the galactomannan may be in a range from about 0.5 percent by weight to about 2 percent by weight. Preferably the galactomannan may be in a range from about 1 percent by weight to about 2 percent by weight.

The gel may include a gelatin in a range from about 0.2 percent by weight to about 5 percent by weight. Preferably the gelatin may be in a range from about 0.5 percent by weight to about 3 percent by weight. Preferably the gelatin may be in a range from about 0.5 percent by weight to about 2 percent by weight. Preferably the gelatin may be in a range from about 1 percent by weight to about 2 percent by weight.

The gel may include agarose in a range from about 0.2 percent by weight to about 5 percent by weight. Preferably the agarose may be in a range from about 0.5 percent by weight to about 3 percent by weight. Preferably the agarose may be in a range from about 0.5 percent by weight to about 2 percent by weight. Preferably the agarose may be in a range from about 1 percent by weight to about 2 percent by weight.

The gel may include konjac gum in a range from about 0.2 percent by weight to about 5 percent by weight. Preferably the konjac gum may be in a range from about 0.5 percent by weight to about 3 percent by weight. Preferably the konjac gum may be in a range from about 0.5 percent by weight to about 2 percent by weight. Preferably the konjac gum may be in a range from about 1 percent by weight to about 2 percent by weight.

The gel may include agar in a range from about 0.2 percent by weight to about 5 percent by weight. Preferably the agar may be in a range from about 0.5 percent by weight to about 3 percent by weight. Preferably the agar may be in a range from about 0.5 percent by weight to about 2 percent by weight. Preferably the agar may be in a range from about 1 percent by weight to about 2 percent by weight.

The term "ionic crosslinking gelling agent" refers to a gelling agent that forms non-covalent crosslinking bonds or physical crosslinking bonds via ionic bonding. Ionic crosslinking involves the association of polymer chains by non-covalent interactions. A crosslinked network is formed when multivalent molecules of opposite charges electrostatically attract each other giving rise to a crosslinked polymeric network.

The ionic crosslinking gelling agent may include low acyl gellan, pectin, kappa carrageenan, iota carrageenan or alginate. The ionic crosslinking gelling agent may preferably include low acyl gellan.

The gel may include the ionic crosslinking gelling agent in a range from about 0.3 percent by weight to about 5 percent by weight. Preferably the gel includes the ionic crosslinking gelling agent in a range from about 0.5 percent by weight to about 3 percent by weight by weight. Preferably the gel includes the ionic crosslinking gelling agent in a range from about 1 percent by weight to about 2 percent by weight.

The gel may include low acyl gellan in a range from about 0.2 percent by weight to about 5 percent by weight. Preferably the low acyl gellan may be in a range from about 0.5 percent by weight to about 3 percent by weight. Preferably the low acyl gellan may be in a range from about 0.5 percent by weight to about 2 percent by weight. Preferably the low acyl gellan may be in a range from about 1 percent by weight to about 2 percent by weight.

The gel may include pectin in a range from about 0.2 percent by weight to about 5 percent by weight. Preferably the pectin may be in a range from about 0.5 percent by weight to about 3 percent by weight. Preferably the pectin may be in a range from about 0.5 percent by weight to about 2 percent by weight. Preferably the pectin may be in a range from about 1 percent by weight to about 2 percent by weight.

The gel may include kappa carrageenan in a range from about 0.2 percent by weight to about 5 percent by weight. Preferably the kappa carrageenan may be in a range from about 0.5 percent by weight to about 3 percent by weight.

Preferably the kappa carrageenan may be in a range from about 0.5 percent by weight to about 2 percent by weight. Preferably the kappa carrageenan may be in a range from about 1 percent by weight to about 2 percent by weight.

The gel may include iota carrageenan in a range from about 0.2 percent by weight to about 5 percent by weight. Preferably the iota carrageenan may be in a range from about 0.5 percent by weight to about 3 percent by weight. Preferably the iota carrageenan may be in a range from about 0.5 percent by weight to about 2 percent by weight. Preferably the iota carrageenan may be in a range from about 1 percent by weight to about 2 percent by weight.

The gel may include alginate in a range from about 0.2 percent by weight to about 5 percent by weight. Preferably the alginate may be in a range from about 0.5 percent by weight to about 3 percent by weight. Preferably the alginate may be in a range from about 0.5 percent by weight to about 2 percent by weight. Preferably the alginate may be in a range from about 1 percent by weight to about 2 percent by weight.

The gel may include the hydrogen-bond crosslinking gelling agent and ionic crosslinking gelling agent in a ratio of about 3:1 to about 1:3. Preferably the gel may include the hydrogen-bond crosslinking gelling agent and ionic crosslinking gelling agent in a ratio of about 2:1 to about 1:2. Preferably the gel may include the hydrogen-bond crosslinking gelling agent and ionic crosslinking gelling agent in a ratio of about 1:1.

The gel may further include a viscosifying agent. The viscosifying agent combined with the hydrogen-bond crosslinking gelling agent and the ionic crosslinking gelling agent appears to surprisingly support the solid medium and maintain the gel composition even when the gel composition comprises a high level of glycerol.

The term "viscosifying agent" refers to a compound that, when added homogeneously into a 25° C., 50 percent by weight water/50 percent by weight glycerol mixture, in an amount of 0.3 percent by weight, increases the viscosity without leading to the formation of a gel, the mixture staying or remaining fluid. Preferably the viscosifying agent refers to a compound that when added homogeneously into a 25° C. 50 percent by weight water/50 percent by weight glycerol mixture, in an amount of 0.3 percent by weight, increases the viscosity to at least 50 cPs, preferably at least 200 cPs, preferably at least 500 cPs, preferably at least 1000 cPs at a shear rate of 0.1 $s^{-1}$, without leading to the formation of a gel, the mixture staying or remaining fluid. Preferably the viscosifying agent refers to a compound that when added homogeneously into a 25° C. 50 percent by weight water/50 percent by weight glycerol mixture, in an amount of 0.3 percent by weight, increases the viscosity at least 2 times, or at least 5 times, or at least 10 times, or at least 100 times higher than before addition, at a shear rate of 0.1 $s^{-1}$, without leading to the formation of a gel, the mixture staying or remaining fluid.

The viscosity values recited herein can be measured using a Brookfield RVT viscometer rotating a disc type RV #2 spindle at 25° C. at a speed of 6 revolutions per minute (rpm).

The gel preferably includes the viscosifying agent in a range from about 0.2 percent by weight to about 5 percent by weight. Preferably the gel includes the viscosifying agent in a range from about 0.5 percent by weight to about 3 percent by weight. Preferably the gel includes the viscosifying agent in a range from about 0.5 percent by weight to about 2 percent by weight. Preferably the gel includes the viscosifying agent in a range from about 1 percent by weight to about 2 percent by weight.

The viscosifying agent may include one or more of xanthan gum, carboxymethyl-cellulose, microcrystalline cellulose, methyl cellulose, gum Arabic, guar gum, lambda carrageenan, or starch. The viscosifying agent may preferably include xanthan gum.

The gel may include xanthan gum in a range from about 0.2 percent by weight to about 5 percent by weight. Preferably the xanthan gum may be in a range from about 0.5 percent by weight to about 3 percent by weight. Preferably the xanthan gum may be in a range from about 0.5 percent by weight to about 2 percent by weight. Preferably the xanthan gum may be in a range from about 1 percent by weight to about 2 percent by weight.

The gel may include carboxymethyl-cellulose in a range from about 0.2 percent by weight to about 5 percent by weight. Preferably the carboxymethyl-cellulose may be in a range from about 0.5 percent by weight to about 3 percent by weight. Preferably the carboxymethyl-cellulose may be in a range from about 0.5 percent by weight to about 2 percent by weight. Preferably the carboxymethyl-cellulose may be in a range from about 1 percent by weight to about 2 percent by weight.

The gel may include microcrystalline cellulose in a range from about 0.2 percent by weight to about 5 percent by weight. Preferably the microcrystalline cellulose may be in a range from about 0.5 percent by weight to about 3 percent by weight. Preferably the microcrystalline cellulose may be in a range from about 0.5 percent by weight to about 2 percent by weight. Preferably the microcrystalline cellulose may be in a range from about 1 percent by weight to about 2 percent by weight.

The gel may include methyl cellulose in a range from about 0.2 percent by weight to about 5 percent by weight. Preferably the methyl cellulose may be in a range from about 0.5 percent by weight to about 3 percent by weight. Preferably the methyl cellulose may be in a range from about 0.5 percent by weight to about 2 percent by weight. Preferably the methyl cellulose may be in a range from about 1 percent by weight to about 2 percent by weight.

The gel may include gum Arabic in a range from about 0.2 percent by weight to about 5 percent by weight. Preferably the gum Arabic may be in a range from about 0.5 percent by weight to about 3 percent by weight. Preferably the gum Arabic may be in a range from about 0.5 percent by weight to about 2 percent by weight. Preferably the gum Arabic may be in a range from about 1 percent by weight to about 2 percent by weight.

The gel may include guar gum in a range from about 0.2 percent by weight to about 5 percent by weight. Preferably the guar gum may be in a range from about 0.5 percent by weight to about 3 percent by weight. Preferably the guar gum may be in a range from about 0.5 percent by weight to about 2 percent by weight. Preferably the guar gum may be in a range from about 1 percent by weight to about 2 percent by weight.

The gel may include lambda carrageenan in a range from about 0.2 percent by weight to about 5 percent by weight. Preferably the lambda carrageenan may be in a range from about 0.5 percent by weight to about 3 percent by weight. Preferably the lambda carrageenan may be in a range from about 0.5 percent by weight to about 2 percent by weight. Preferably the lambda carrageenan may be in a range from about 1 percent by weight to about 2 percent by weight.

The gel may include starch in a range from about 0.2 percent by weight to about 5 percent by weight. Preferably the starch may be in a range from about 0.5 percent by weight to about 3 percent by weight. Preferably the starch may be in a range from about 0.5 percent by weight to about 2 percent by weight. Preferably the starch may be in a range from about 1 percent by weight to about 2 percent by weight.

The gel may further include a divalent cation. Preferably the divalent cation includes calcium ions, such as calcium lactate in solution. Divalent cations (such as calcium ions) may assist in the gel formation of compositions that include gelling agents such as the ionic crosslinking gelling agent, for example. The ion effect may assist in the gel formation. The divalent cation may be present in the gel composition in a range from about 0.1 to about 1 percent by weight, or about 0.5 percent by weight to about 1 percent by weight.

The gel may further include an acid. The acid may comprise a carboxylic acid. The carboxylic acid may include a ketone group. Preferably the carboxylic acid may include a ketone group having less than about 10 carbon atoms, or less than about 6 carbon atoms or less than about 4 carbon atoms, such as levulinic acid or lactic acid. Preferably this carboxylic acid has three carbon atoms (such as lactic acid). Lactic acid surprisingly improves the stability of the gel even over similar carboxylic acids. The carboxylic acid may assist in the gel formation. The carboxylic acid may reduce variation of the alkaloid compound concentration within the gel during storage. The carboxylic acid may reduce variation of the nicotine concentration within the gel during storage.

The gel may include a carboxylic acid in a range from about 0.1 percent by weight to about 5 percent by weight. Preferably the carboxylic acid may be in a range from about 0.5 percent by weight to about 3 percent by weight. Preferably the carboxylic acid may be in a range from about 0.5 percent by weight to about 2 percent by weight. Preferably the carboxylic acid may be in a range from about 1 percent by weight to about 2 percent by weight.

The gel may include lactic acid in a range from about 0.1 percent by weight to about 5 percent by weight. Preferably the lactic acid may be in a range from about 0.5 percent by weight to about 3 percent by weight. Preferably the lactic acid may be in a range from about 0.5 percent by weight to about 2 percent by weight. Preferably the lactic acid may be in a range from about 1 percent by weight to about 2 percent by weight.

The gel may include levulinic acid in a range from about 0.1 percent by weight to about 5 percent by weight. Preferably the levulinic acid may be in a range from about 0.5 percent by weight to about 3 percent by weight. Preferably the levulinic acid may be in a range from about 0.5 percent by weight to about 2 percent by weight. Preferably the levulinic acid may be in a range from about 1 percent by weight to about 2 percent by weight.

The gel preferably comprises some water. The gel is more stable when the gel comprises some water. Preferably the gel comprises at least about 1 percent by weight, or at least about 2 percent by weight, or at least about 5 percent by weight of water. Preferably the gel comprises at least about 10 percent by weight or at least about 15 percent by weight water.

Preferably the gel comprises between about 8 percent by weight to about 32 percent by weight water. Preferably the gel comprises from about 15 percent by weight to about 25 percent by weight water. Preferably the gel comprises from about 18 percent by weight to about 22 percent by weight water. Preferably the gel comprises about 20 percent by weight water.

In preferred embodiments, the aerosol-generating rod additionally comprises a non-aerosol-generating segment at a location downstream of the first aerosol-generating segment. The non-aerosol-generating segment comprises a plug of a porous substrate. The plug of porous substrate is substantially free of any aerosol-generating compounds.

Advantageously, the non-aerosol-generating segment supports the first aerosol-generating segment and may help prevent any of the tobacco material contained in the first aerosol-generating segment from becoming dislodged. Further, the non-aerosol-generating segment contributes to the overall structural strength of the rod and facilitates handling thereof, particularly during manufacture.

Preferably, the plug of porous substrate of the non-aerosol-generating segment substantially does not contribute to an overall RTD of the rod.

An external diameter of the non-aerosol-generating segment is substantially the same as an external diameter of the rod.

The non-aerosol-generating segment may have a length of at least about 2 millimetres. Preferably, the non-aerosol-generating segment has a length of at least about 3 millimetres. More preferably, the non-aerosol-generating segment has a length of at least about 4 millimetres.

The non-aerosol-generating segment may have a length of up to about 10 millimetres. Preferably, the non-aerosol-generating segment has a length of less than or equal to about 7 millimetres. More preferably, the non-aerosol-generating segment has a length of less than or equal to about 5 millimetres.

In some embodiments, the non-aerosol-generating segment has a length from about 2 millimetres to about 10 millimetres, preferably from about 3 millimetres to about 10 millimetres, more preferably from about 4 millimetres to about 10 millimetres. In other embodiments, the non-aerosol-generating segment has a length from about 2 millimetres to about 17 millimetres, preferably from about 3 millimetres to about 7 millimetres, more preferably from about 4 millimetres to about 7 millimetres. In further embodiments, the non-aerosol-generating segment has a length from about 2 millimetres to about 5 millimetres, preferably from about 3 millimetres to about 5 millimetres, more preferably from about 4 millimetres to about 5 millimetres.

As will be already apparent from the above description, an aerosol-generating rod in accordance with the present invention finds use for the manufacture of an aerosol-generating article, such as an aerosol-generating article for producing an inhalable aerosol upon heating.

An aerosol-generating article in accordance with the present invention comprises an aerosol-generating rod as described above, and may additionally comprise a downstream section at a location downstream of the aerosol-generating rod. In addition, or as an alternative, an aerosol-generating article in accordance with the present invention may comprise an upstream section at a location upstream of the aerosol-generating rod.

The downstream section may comprise one or more downstream elements.

The downstream section may comprise a support element arranged in alignment with, and downstream of the aerosol-generating rod. In particular, the support element may be located immediately downstream of the aerosol-generating rod and may abut the aerosol-generating rod.

The support element may be formed from any suitable material or combination of materials. For example, the support element may be formed from one or more materials selected from the group consisting of: cellulose acetate; cardboard; crimped paper, such as crimped heat resistant paper or crimped parchment paper; and polymeric materials, such as low density polyethylene (LDPE). In a preferred embodiment, the support element is formed from cellulose acetate. Other suitable materials include polyhydroxyalkanoate (PHA) fibres.

The support element may comprise a hollow tubular segment. In a preferred embodiment, the support element comprises a hollow cellulose acetate tube.

The support element is arranged substantially in alignment with the aerosol-generating rod. This means that the length dimension of the support element is arranged to be approximately parallel to the longitudinal direction of the rod and of the article, for example within plus or minus 10 degrees of parallel to the longitudinal direction of the rod. In preferred embodiments, the support element extends along the longitudinal axis of the rod.

The support element preferably has an outer diameter that is approximately equal to the outer diameter of the aerosol-generating rod.

A peripheral wall of the support element may have a thickness of at least 1 millimetre, preferably at least about 1.5 millimetres, more preferably at least about 2 millimetres.

The support element may have a length of between about 5 millimetres and about 15 millimetres. Preferably, the support element has a length of at least about 6 millimetres, more preferably at least about 7 millimetres. In preferred embodiments, the support element has a length of less than about 12 millimetres, more preferably less than about 10 millimetres.

In some embodiments, the support element has a length from about 5 millimetres to about 15 millimetres, preferably from about 6 millimetres to about 15 millimetres, more preferably from about 7 millimetres to about 15 millimetres. In other embodiments, the support element has a length from about 5 millimetres to about 12 millimetres, preferably from about 6 millimetres to about 12 millimetres, more preferably from about 7 millimetres to about 12 millimetres. In further embodiments, the support element has a length from about 5 millimetres to about 10 millimetres, preferably from about 6 millimetres to about 10 millimetres, more preferably from about 7 millimetres to about 10 millimetres.

In a preferred embodiment, the support element has a length of about 8 millimetres. Preferably, the hollow tubular segment of the support element is adapted to generate a RTD between approximately 0 millimetres $H_2O$ (about 0 Pa) to approximately 20 millimetres $H_2O$ (about 100 Pa), more preferably between approximately 0 millimetres $H_2O$ (about 0 Pa) to approximately 10 millimetres $H_2O$ (about 100 Pa). The support element therefore preferably does not contribute to the overall RTD of the aerosol-generating article.

In certain preferred embodiments, the downstream section of the aerosol-generating article comprises a mouthpiece element positioned downstream of the aerosol-generating rod and in longitudinal alignment with the aerosol-generating rod.

The mouthpiece element is preferably located at the downstream end or mouth end of the aerosol-generating article, and extends all the way to the mouth end of the aerosol-generating article.

Preferably, the mouthpiece element comprises at least one mouthpiece filter segment of a fibrous filtration material for filtering the aerosol that is generated from the aerosol-generating substrate. Suitable fibrous filtration materials would be known to the skilled person. Particularly preferably, the at least one mouthpiece filter segment comprises a cellulose acetate filter segment formed of cellulose acetate tow.

In certain preferred embodiments, the mouthpiece element consists of a single mouthpiece filter segment. In alternative embodiments, the mouthpiece element includes two or more mouthpiece filter segments axially aligned in an abutting end to end relationship with each other.

In certain embodiments of the invention, the downstream section may comprise a mouth end cavity at the downstream end, downstream of the mouthpiece element as described above. The mouth end cavity may be defined by a hollow tubular element provided at the downstream end of the mouthpiece. The mouth end cavity may be defined by the outer wrapper of the mouthpiece element, wherein the outer wrapper extends in a downstream direction from the mouthpiece element.

The mouthpiece element may optionally comprise a flavourant, which may be provided in any suitable form. For example, the mouthpiece element may comprise one or more capsules, beads or granules of a flavourant, or one or more flavour loaded threads or filaments.

In certain preferred embodiments, the downstream section of the aerosol-generating article further comprises both a support element located immediately downstream of the aerosol-generating rod and a mouthpiece element located downstream of the support element.

Preferably, the mouthpiece element has a low particulate filtration efficiency.

Preferably, the mouthpiece is formed of a segment of a fibrous filtration material.

Preferably, the mouthpiece element is circumscribed by a plug wrap. Preferably, the mouthpiece element is unventilated such that air does not enter the aerosol-generating article along the mouthpiece element.

The mouthpiece element is preferably connected to one or more of the adjacent upstream components of the aerosol-generating article by means of a tipping wrapper.

Preferably, the mouthpiece element has an RTD of less than about 25 millimetres $H_2O$. More preferably, the mouthpiece element has an RTD of less than about 20 millimetres $H_2O$. Even more preferably, the mouthpiece element has an RTD of less than about 15 millimetres $H_2O$.

Values of RTD from about 10 millimetres $H_2O$ to about to about 15 millimetres $H_2O$ are particularly preferred because a mouthpiece element having one such RTD is expected to contribute minimally to the overall RTD of the aerosol-generating article substantially does not exert a filtration action on the aerosol being delivered to the consumer.

The mouthpiece element preferably has an external diameter that is approximately equal to the external diameter of the aerosol-generating article.

The mouthpiece element preferably has a length of at least about 5 millimetres, more preferably at least about 8 millimetres, more preferably at least about 10 millimetres. The mouthpiece element preferably has a length of less than about 25 millimetres, more preferably less than about 20 millimetres, more preferably less than about 15 millimetres.

In some embodiments, the mouthpiece element preferably has a length from about 5 millimetres to about 25 millimetres, more preferably from about 8 millimetres to about 25 millimetres, even more preferably from about 10 millimetres to about 25 millimetres. In other embodiments, the mouthpiece element preferably has a length from about 5 millimetres to about 10 millimetres, more preferably from about 8 millimetres to about 20 millimetres, even more preferably from about 10 millimetres to about 20 millimetres. In further embodiments, the mouthpiece element preferably has a length from about 5 millimetres to about 15 millimetres, more preferably from about 8 millimetres to about 15 millimetres, even more preferably from about 10 millimetres to about 15 millimetres.

For example, the mouthpiece element may have a length of between about 5 millimetres and about 25 millimetres, or between about 8 millimetres and about 20 millimetres, or between about 10 millimetres and about 15 millimetres. In a preferred embodiment, the mouthpiece element has a length of approximately 12 millimetres.

In particularly preferred embodiments, the downstream section may further comprise an aerosol-cooling element located downstream of the support element, with the mouthpiece element located downstream of both the support element and the aerosol-cooling element. Particularly preferably, the mouthpiece element is located immediately downstream of the aerosol-cooling element. By way of example, the mouthpiece element may abut the downstream end of the aerosol-cooling element.

The aerosol-cooling element may for example define a plurality of longitudinally extending channels such as to make a high surface area available for heat exchange. The plurality of longitudinally extending channels may be defined by a sheet material that has been pleated, gathered or folded to form the channels. The plurality of longitudinally extending channels may be defined by a single sheet that has been pleated, gathered or folded to form multiple channels. The sheet may also have been crimped prior to being pleated, gathered or folded. The plurality of longitudinally extending channels may be defined by multiple sheets that have been crimped, pleated, gathered or folded to form multiple channels. In some embodiments, the plurality of longitudinally extending channels may be defined by multiple sheets that have been crimped, pleated, gathered or folded together—that is by two or more sheets that have been brought into overlying arrangement and then crimped, pleated, gathered or folded as one.

One such aerosol-cooling element may have a total surface area of between about 300 square millimetre per millimetre length and about 1000 square millimetres per millimetre length.

One such aerosol-cooling element preferably offers a low resistance to the passage of air through additional cooling element. Preferably, the aerosol-cooling element does not substantially affect the resistance to draw of the aerosol-generating article. The aerosol-cooling element preferably comprises a sheet material selected from the group comprising a metallic foil, a polymeric sheet, and a substantially non-porous paper or cardboard. In some embodiments, the aerosol-cooling element may comprise a sheet material selected from the group consisting of polyethylene (PE), polypropylene (PP), polyvinylchloride (PVC), polyethylene terephthalate (PET), polylactic acid (PLA), cellulose acetate (CA), and aluminium foil. In a particularly preferred embodiment, the additional cooling element comprises a sheet of PLA.

The aerosol-generating article may further comprise an upstream section at a location upstream of the aerosol-generating element. The upstream section may comprise one or more upstream elements. In some embodiments, the upstream section may comprise an upstream element arranged immediately upstream of the aerosol-generating element.

The upstream element may provide an improved appearance to the upstream end of the aerosol-generating article. Furthermore, if desired, the upstream element may be used to provide information on the aerosol-generating article, such as information on brand, flavour, content, or details of the aerosol-generating device that the article is intended to be used with.

The upstream element may be a porous plug element. Preferably, a porous plug element does not alter the resistance to draw of the aerosol-generating article. Preferably, the upstream element has a porosity of at least about 50 percent in the longitudinal direction of the aerosol-generating article. More preferably, the upstream element has a porosity of between about 50 percent and about 90 percent in the longitudinal direction. The porosity of the upstream element in the longitudinal direction is defined by the ratio of the cross-sectional area of material forming the upstream element and the internal cross-sectional area of the aerosol-generating article at the position of the upstream element.

The upstream element may be made of a porous material or may comprise a plurality of openings. This may, for example, be achieved through laser perforation. Preferably, the plurality of openings is distributed homogeneously over the cross-section of the upstream element.

The porosity or permeability of the upstream element may advantageously be varied in order to provide a desirable overall resistance to draw of the aerosol-generating article.

Preferably, the RTD of the upstream element is at least about 5 millimetres $H_2O$. More preferably, the RTD of the upstream element is at least about 10 millimetres $H_2O$. Even more preferably, the RTD of the upstream element is at least about 15 millimetres $H_2O$. In particularly preferred embodiments, the RTD of the upstream element is at least about 20 millimetres $H_2O$.

The RTD of the upstream element is preferably less than or equal to about 80 millimetres $H_2O$. More preferably, the RTD of the upstream element is less than or equal to about 60 millimetres $H_2O$. Even more preferably, the RTD of the upstream element is less than or equal to about 40 millimetres $H_2O$.

In some embodiments, the RTD of the upstream element is from about 5 millimetres $H_2O$ to about 80 millimetres $H_2O$, preferably from about 10 millimetres $H_2O$ to about 80 millimetres $H_2O$, more preferably from about 15 millimetres $H_2O$ to about 80 millimetres $H_2O$, even more preferably from about 20 millimetres $H_2O$ to about 80 millimetres $H_2O$. In other embodiments, the RTD of the upstream element is from about 5 millimetres $H_2O$ to about 60 millimetres $H_2O$, preferably from about 10 millimetres $H_2O$ to about 60 millimetres $H_2O$, more preferably from about 15 millimetres $H_2O$ to about 60 millimetres $H_2O$, even more preferably from about 20 millimetres $H_2O$ to about 60 millimetres $H_2O$. In further embodiments, the RTD of the upstream element is from about 5 millimetres $H_2O$ to about 40 millimetres $H_2O$, preferably from about 10 millimetres $H_2O$ to about 40 millimetres $H_2O$, more preferably from about 15 millimetres $H_2O$ to about 40 millimetres $H_2O$, even more preferably from about 20 millimetres $H_2O$ to about 40 millimetres $H_2O$.

In alternative embodiments, the upstream element may be formed from a material that is impermeable to air. In such embodiments, the aerosol-generating article may be configured such that air flows into the aerosol-generating rod through suitable ventilation means provided in a wrapper.

The upstream element may be made of any material suitable for use in an aerosol-generating article. The upstream element may, for example, be made of a same material as used for one of the other components of the aerosol-generating article, such as the mouthpiece, the cooling element or the support element. Suitable materials for forming the upstream element include filter materials, ceramic, polymer material, cellulose acetate, cardboard, zeolite or aerosol-generating substrate. Preferably, the upstream element is formed from a plug of cellulose acetate.

Preferably, the upstream element is formed of a heat resistant material. For example, preferably the upstream element is formed of a material that resists temperatures of up to 350 degrees Celsius. This ensures that the upstream element is not adversely affected by the heating means for heating the aerosol-generating substrate.

Preferably, the upstream element has a diameter that is approximately equal to the diameter of the aerosol-generating article.

Preferably, the upstream element has a length of between about 1 millimetre and about 10 millimetres, more preferably between about 3 millimetres and about 8 millimetres, more preferably between about 4 millimetres and about 6 millimetres. In a particularly preferred embodiment, the upstream element has a length of about 5 millimetres. The length of the upstream element can advantageously be varied in order to provide the desired total length of the aerosol-generating article. For example, where it is desired to reduce the length of one of the other components of the aerosol-generating article, the length of the upstream element may be increased in order to maintain the same overall length of the article.

The upstream element preferably has a substantially homogeneous structure. For example, the upstream element may be substantially homogeneous in texture and appearance. The upstream element may, for example, have a continuous, regular surface over its entire cross section. The upstream element may, for example, have no recognisable symmetries.

The upstream element is preferably circumscribed by a wrapper. The wrapper circumscribing the upstream element is preferably a stiff plug wrap, for example, a plug wrap having a basis weight of at least about 80 grams per square metre (gsm), or at least about 100 gsm, or at least about 110 gsm. This provides structural rigidity to the upstream element.

The aerosol-generating article may have a length from about 35 millimetres to about 100 millimetres.

The aerosol-generating article may have a length from about 35 millimetres to about 100 millimetres.

Preferably, an overall length of an aerosol-generating article in accordance with the invention is at least about 38 millimetres. More preferably, an overall length of an aerosol-generating article in accordance with the invention is at least about 40 millimetres. Even more preferably, an overall length of an aerosol-generating article in accordance with the invention is at least about 42 millimetres.

An overall length of an aerosol-generating article in accordance with the invention is preferably less than or equal to 70 millimetres. More preferably, an overall length of an aerosol-generating article in accordance with the invention is preferably less than or equal to 60 millimetres. Even more preferably, an overall length of an aerosol-generating article in accordance with the invention is preferably less than or equal to 50 millimetres.

In some embodiments, an overall length of the aerosol-generating article is preferably from about 38 millimetres to about 70 millimetres, more preferably from about 40 millimetres to about 70 millimetres, even more preferably from about 42 millimetres to about 70 millimetres. In other embodiments, an overall length of the aerosol-generating article is preferably from about 38 millimetres to about 60 millimetres, more preferably from about 40 millimetres to about 60 millimetres, even more preferably from about 42 millimetres to about 60 millimetres. In further embodiments, an overall length of the aerosol-generating article is preferably from about 38 millimetres to about 50 millimetres, more preferably from about 40 millimetres to about 50 millimetres, even more preferably from about 42 millimetres to about 50 millimetres. In an exemplary embodiment, an overall length of the aerosol-generating article is about 45 millimetres.

The aerosol-generating article has an external diameter of at least 5 millimetres. Preferably, the aerosol-generating article has an external diameter of at least 6 millimetres. More preferably, the aerosol-generating article has an external diameter of at least 7 millimetres.

Preferably, the aerosol-generating article has an external diameter of less than or equal to about 12 millimetres. More preferably, the aerosol-generating article has an external diameter of less than or equal to about 10 millimetres. Even more preferably, the aerosol-generating article has an external diameter of less than or equal to about 8 millimetres.

In some embodiments, the aerosol-generating article has an external diameter from about 5 millimetres to about 12 millimetres, preferably from about 6 millimetres to about 12 millimetres, more preferably from about 7 millimetres to about 12 millimetres. In other embodiments, the aerosol-generating article has an external diameter from about 5 millimetres to about 10 millimetres, preferably from about 6 millimetres to about 10 millimetres, more preferably from about 7 millimetres to about 10 millimetres. In further embodiments, the aerosol-generating article has an external diameter from about 5 millimetres to about 8 millimetres, preferably from about 6 millimetres to about 8 millimetres, more preferably from about 7 millimetres to about 8 millimetres.

In a particularly preferred embodiment, an aerosol-generating article in accordance with the present invention comprises, in linear sequential arrangement, an upstream element, an aerosol-generating rod located immediately downstream of the upstream element, a support element located immediately downstream of the aerosol-generating element, a mouthpiece element located immediately downstream of the support element, and an outer wrapper circumscribing the upstream element, the aerosol-generating element, the support element, and the mouthpiece element.

In more detail, the aerosol-generating rod may abut the upstream element. The support element may abut the aerosol-generating rod. The aerosol-cooling element may abut the support element. The mouthpiece element may abut the aerosol-cooling element.

The aerosol-generating article has a substantially cylindrical shape and an outer diameter of about 7.25 millimetres.

The upstream element has a length of about 9 millimetres, the aerosol-generating element has a length of about 12 millimetres, the support element has a length of about 18 millimetres, the mouthpiece element has a length of about 8 millimetres. Thus, an overall length of the aerosol-generating article is about 47 millimetres.

The upstream element is in the form of a plug of cellulose acetate wrapped in stiff plug wrap.

The aerosol-generating rod comprises, in linear sequential arrangement, a second aerosol-generating segment comprising a plug of porous substrate and an aerosol-generating gel as described above provided in a core portion of the plug; a first aerosol-generating segment comprising a gathered sheet of homogenised tobacco material; and a non-aerosol-generating segment comprising a plug of porous substrate.

The mouthpiece is in the form of a low-density cellulose acetate filter segment.

Aerosol-generating rods and articles in accordance with the present invention may be used in an aerosol-generating device comprising a heater for heating a rod or article. Thus, the invention also relates to an aerosol-generating system comprising one such aerosol-generating device, such as an electrically heated aerosol-generating device, and an aerosol-generating article including an aerosol-generating rod as described above. Examples of suitable aerosol-generating devices will be known to the person of skill in the art. In general, suitable aerosol-generating devices will comprise a heating chamber for receiving at least the first and second aerosol-generating segments, and a heater adapted to heat the first and second aerosol-generating segments when they are received within the chamber.

This includes, but is not limited to, aerosol-generating devices including one or more induction heaters arranged about the periphery of a susceptor tubular element defining the heating chamber. Aerosol-generating devices comprising other types of external heater elements may also be suitable.

The invention is defined in the claims. However, below there is provided a non-exhaustive list of non-limiting examples. Any one or more of the features of these examples may be combined with any one or more features of another example, embodiment, or aspect described herein.

Example 1. An aerosol-generating rod for producing an inhalable aerosol upon heating, the aerosol-generating rod comprising: a first aerosol-generating segment comprising a first aerosol-generating substrate, wherein the first aerosol-generating substrate comprises a tobacco material and an aerosol former; and a second aerosol-generating segment at a location upstream of the first aerosol-generating segment; wherein the second aerosol-generating segment comprises a plug of a porous substrate and wherein at least a core portion of the plug comprises an aerosol-generating medium or a flavourant or both.

Example 2. An aerosol-generating rod according to Example 1, wherein a peripheral portion of the plug is substantially free of aerosol-generating medium or flavourant.

Example 3. An aerosol-generating rod according to Example 1 or 2, comprising a non-aerosol-generating segment at a location downstream of the first aerosol-generating segment, wherein the non-aerosol-generating segment comprises a plug of a porous substrate.

Example 4. An aerosol-generating rod according to any one of Examples 1 to 3, comprising a non-porous wrapper circumscribing at least the first aerosol-generating segment and the second aerosol-generating segment.

Example 5. An aerosol-generating rod according to Example 4 wherein the non-porous wrapper comprises metallic foil.

Example 6. An aerosol-generating rod according to any one of the preceding Examples wherein the first aerosol-generating substrate comprises one or more of homogenised tobacco material, tobacco cast leaf and reconstituted tobacco.

Example 7. An aerosol-generating rod according to any one of the preceding Examples wherein the first aerosol-generating substrate further comprises non-tobacco plant material.

Example 8. An aerosol-generating rod according to any one of the preceding Examples wherein the aerosol-generating medium comprises a liquid or gel impregnating the porous substrate.

Example 9. An aerosol-generating rod according to any one of the preceding Examples wherein the aerosol-generating medium comprises a gel comprising an alkaloid compound; an aerosol former; and at least one gelling agent.

Example 10. An aerosol-generating rod according to any one of the preceding Examples, wherein a length of the first aerosol-generating segment is from 5 millimetres to 25 millimetres.

Example 11. An aerosol-generating rod according to any one of the preceding Examples, wherein a length of the second aerosol-generating segment is from 2 millimetres to 10 millimetres.

Example 12. An aerosol-generating rod according to any one of the preceding Examples, wherein a ratio between a length of the first aerosol-generating segment and a length of the second aerosol-generating segment is from 0.15 to 0.5.

Example 13. An aerosol-generating rod according to any one of the preceding Examples, wherein a cross-sectional area of the core portion is at least 50 percent of a cross-sectional area of the second segment.

Example 14. An aerosol-generating article comprising an aerosol-generating rod according to any one of the preceding Examples.

Example 15. An aerosol-generating system comprising a heating device and an aerosol-generating article according to Example 14.

In the following, the invention will be further described with reference to the drawings of the accompanying Figures, wherein.

Figure 1A:
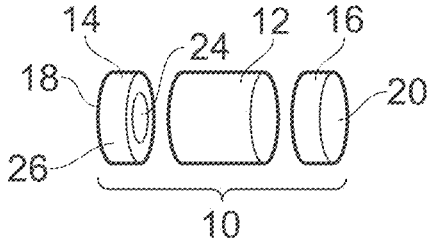
FIGS. 1A and 1B shows a schematic perspective views of an aerosol-generating rod in accordance with the present invention with the wrapper removed.

The aerosol-generating rod 10 shown in FIG. 1 comprises a first aerosol-generating segment 12 and a second aerosol-generating segment 14 at a location upstream of the first aerosol-generating segment 12. Further, the aerosol-generating rod 10 comprises a non-aerosol-generating segment 16 at a location downstream of the first aerosol-generating segment 12.

The first aerosol-generating segment 12, the second aerosol-generating segment 14 and the non-aerosol-generating segment 16 are in linear sequential arrangement. The first aerosol-generating segment 12 is located immediately downstream of the second aerosol-generating segment 14, and the non-aerosol-generating segment 16 is located immediately downstream of the first aerosol-generating segment 12. Even more particularly, an upstream end of the first aerosol-generating segment 12 abuts a downstream end of the second aerosol-generating segment 14, and an upstream end of the non-aerosol-generating segment 16 abuts a downstream end of the first aerosol-generating segment 12. Thus, the aerosol-generating rod 10 extends from an upstream or distal end 18 to a downstream or mouth end

Figure 1B:
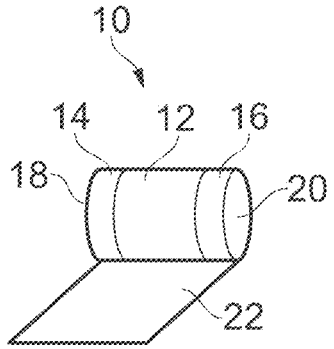
Figure 1C:
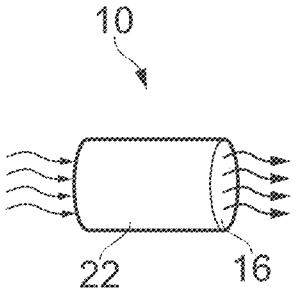
FIG. 1C shows a further schematic perspective view of the aerosol-generating rod of FIGS. 1A and 1B.

20. The arrows in FIG. 1C illustrated a direction of airflow through the rod 10 as intended during use.

The first aerosol-generating segment has a length of about 12 millimetres. The second aerosol-generating segment 14 has a length of about 5 millimetres. The non-aerosol-generating segment 16 has a length of about 3 millimetres. Thus, the aerosol-generating rod has an overall length of about 20 millimetres.

The aerosol-generating rod 10 further comprises a wrapper 22 circumscribing the first aerosol-generating segment 12, the second aerosol-generating segment 14 and the non-aerosol-generating segment 16. In the embodiment of FIGS. 1A, 1B and 1C the wrapper is non-porous and is formed of a metallic foil.

The aerosol-generating rod has a diameter of about 7.25 millimetres.

The first aerosol-generating segment 12 comprises a first aerosol-generating substrate comprising a tobacco material and an aerosol former. In more detail, the first aerosol-generating substrate comprises a gathered sheet of homogenised tobacco material.

The second aerosol-generating segment 14 comprises a plug 18 of a porous substrate. A core portion 24 of the plug 18 comprises an aerosol-generating medium. A peripheral portion 26 of the plug surrounding the core portion 18 is substantially free of aerosol-generating medium. A cross-sectional area of the core portion 24 is about 60 percent of a cross-sectional area of the second aerosol-generating segment 14.

Figure 2:
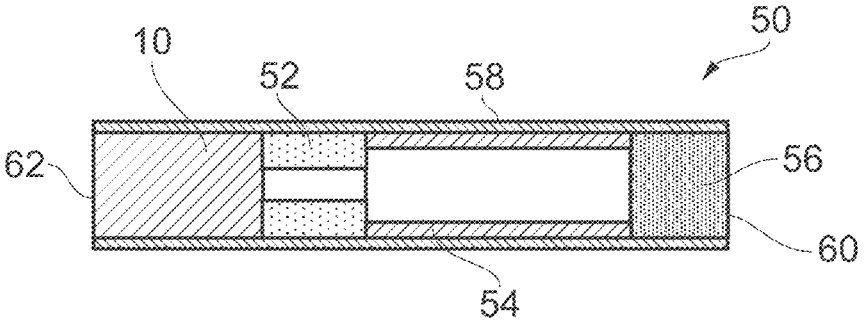
FIG. 2 shows a schematic side sectional view of an aerosol-generating article comprising the aerosol-generating rod of FIGS. 1A, 1B and 1C.
Figure 3:
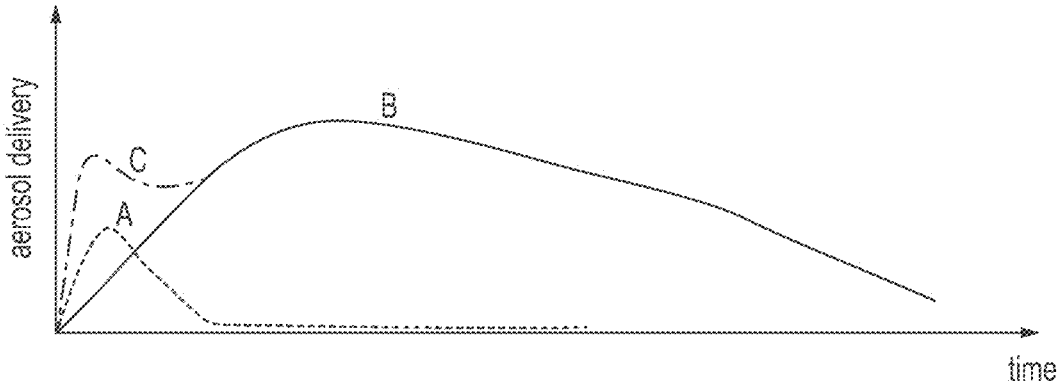
FIG. 3 shows qualitatively how aerosol delivery varies over time during use of the aerosol-generating article of FIG. 2.

The aerosol-generating article 50 shown in FIG. 2 comprises a rod 10 as described above, a hollow cellulose acetate tube 52, a spacer element 54 and a mouthpiece filter 56. These four elements are arranged sequentially and in coaxial alignment and are circumscribed by a wrapper 58 to form the aerosol-generating article 50. The aerosol-generating article 50 has a mouth end 60 and a distal end 62 located at the opposite end of the article to the mouth end 60. The aerosol-generating article 10 shown in FIG. 2 is particularly suitable for use with an electrically operated aerosol-generating device comprising a heater for heating the rod 10.

Figure 4A:
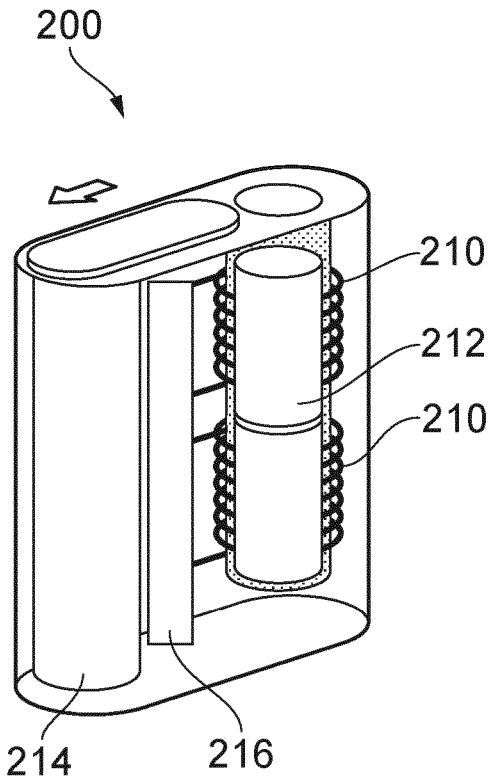
FIGS. 4A and 4B show schematic perspective views of an aerosol-generating system comprising an aerosol-generating device and the aerosol-generating article of FIG. 2.
Figure 4B:
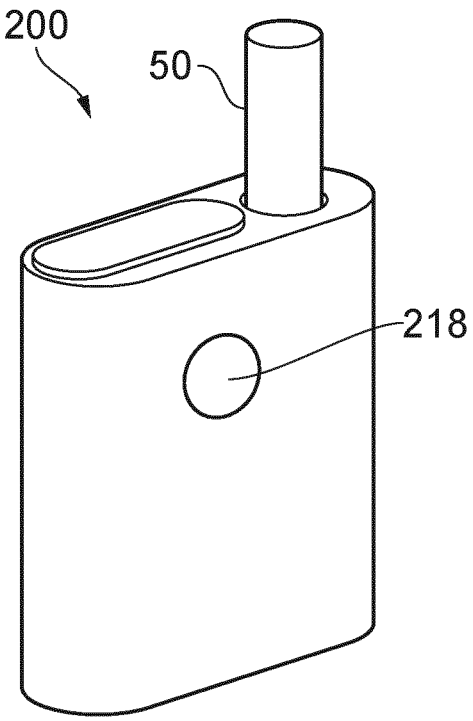

FIGS. 4A and 4B show schematically an electrically operated aerosol-generating device 200 with some elements removed in FIG. 4A. The aerosol-generating device 200 utilises a pair of external inductor coils 210 and a susceptor sleeve 212 to heat the rod 10 of the aerosol-generating article 50 described above. The inductor coils 210 are mounted around the susceptor sleeve 212, which defines a cylindrical chamber for receiving the aerosol-generating article 50, as shown schematically in FIG. 4B.

The aerosol-generating device 200 is powered by a battery 214 and is controlled by electronics 216, and has an on-off button 218.

It will be appreciated that the aerosol-generating rod 10 and the aerosol-generating article 50 described above may also be suitable for use with other types of aerosol-generating devices.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number A is understood as A±10% of A. Within this context, a number A may be considered to include numerical values that are within general standard error for the measurement of the property that the number A modifies. The number A, in some instances as used in the appended claims, may deviate by the percentages enumerated above provided that the amount by which A deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. An aerosol-generating article comprising an aerosol-generating rod for producing an inhalable aerosol upon heating, the aerosol-generating rod comprising:

a first aerosol-generating segment comprising a first aerosol-generating substrate, wherein the first aerosol-generating substrate comprises a tobacco material and an aerosol former;

a second aerosol-generating segment at a location upstream of the first aerosol-generating segment; and a wrapper circumscribing at least the first aerosol-generating segment and the second aerosol-generating segment, wherein the second aerosol-generating segment comprises a plug of a porous substrate comprising a material selected from the group consisting of cotton, viscose, polylactic acid (PLA), cellulose acetate, and combinations thereof, and wherein at least a core portion of the plug comprises an aerosol-generating medium or a flavourant or both.

2. The aerosol-generating article according to claim 1, wherein the plug of the second aerosol-generating segment is free of tobacco material and free of non-tobacco plant material.

3. The aerosol-generating article according to claim 1, further comprising a non-aerosol-generating segment at a location downstream of the first aerosol-generating segment, wherein the non-aerosol-generating segment comprises a plug of a porous substrate.

4. The aerosol-generating article according to claim 1, wherein the wrapper circumscribing at least the first aerosol-generating segment and the second aerosol-generating segment is non-porous.

5. The aerosol-generating article according to claim 4, wherein the non-porous wrapper comprises metallic foil.

6. The aerosol-generating article according to claim 1, wherein the first aerosol-generating substrate further comprises one or more of homogenised tobacco material, tobacco cast leaf, and reconstituted tobacco.

7. The aerosol-generating article according to claim 1, wherein the first aerosol-generating substrate further comprises non-tobacco plant material.

8. The aerosol-generating article according to claim 1, wherein the aerosol-generating medium comprises a liquid or gel impregnating the porous substrate.

9. The aerosol-generating article according to claim 1, wherein the aerosol-generating medium comprises a gel comprising an alkaloid compound, an aerosol former, and at least one gelling agent.

10. The aerosol-generating article according to claim 1, wherein a length of the first aerosol-generating segment is from 5 millimetres to 25 millimetres.

11. The aerosol-generating article according to claim 1, wherein a length of the second aerosol-generating segment is from 2 millimetres to 10 millimetres.

12. The aerosol-generating article according to claim 1, wherein a ratio between a length of the second aerosol-generating segment and a length of the first aerosol-generating segment is from 0.15 to 0.5.

13. The aerosol-generating article according to claim 1, wherein a cross-sectional area of the core portion is at least 50 percent of a cross-sectional area of the second segment.

14. The aerosol-generating article according to claim 1, wherein a peripheral portion of the plug surrounding the core portion is substantially free of aerosol-generating medium or flavourant.

15. An aerosol-generating system comprising a heating device and an aerosol-generating article according to claim 1.

16. The aerosol-generating article according to claim 1, wherein the first aerosol-generating substrate has an aerosol former content of between 5 percent and 30 percent by weight on a dry weight basis.

17. An aerosol-generating article comprising an aerosol-generating rod for producing an inhalable aerosol upon heating, the aerosol-generating rod comprising:

a first aerosol-generating segment comprising a first aerosol-generating substrate, wherein the first aerosol-generating substrate comprises a tobacco material and an aerosol former;

a second aerosol-generating segment at a location upstream of the first aerosol-generating segment; and a wrapper circumscribing at least the first aerosol-generating segment and the second aerosol-generating segment, wherein the second aerosol-generating segment comprises a plug of a porous substrate comprising a material selected from the group consisting of cotton, paper, viscose, polylactic acid (PLA), cellulose acetate, and combinations thereof, wherein at least a core portion of the plug comprises an aerosol-generating medium or a flavourant or both, and wherein the plug of the second aerosol-generating segment is free of tobacco material and free of non-tobacco plant material.

18. An aerosol-generating article comprising an aerosol-generating rod for producing an inhalable aerosol upon heating, the aerosol-generating rod comprising:

a first aerosol-generating segment comprising a first aerosol-generating substrate, wherein the first aerosol-generating substrate comprises a tobacco material and an aerosol former;

a second aerosol-generating segment at a location upstream of the first aerosol-generating segment; and a wrapper circumscribing at least the first aerosol-generating segment and the second aerosol-generating segment, wherein the second aerosol-generating segment comprises a plug of a porous substrate, wherein at least a core portion of the plug comprises an aerosol-generating medium or a flavourant or both, and wherein the plug of the second aerosol-generating segment is free of tobacco material and free of non-tobacco plant material.

* * * * *